US007046220B2

(12) United States Patent
Tagawa et al.

(10) Patent No.: US 7,046,220 B2
(45) Date of Patent: May 16, 2006

(54) DISPLAY AND DRIVING METHOD THEREOF

(75) Inventors: Akira Tagawa, Nara (JP); Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 280 days.

(21) Appl. No.: 10/282,714

(22) Filed: Oct. 29, 2002

(65) Prior Publication Data

US 2003/0090446 A1 May 15, 2003

(30) Foreign Application Priority Data

Nov. 9, 2001 (JP) ..... 2001-345108

(51) Int. Cl.
*G09G 3/30* (2006.01)

(52) U.S. Cl. ..... 345/76; 315/169.3

(58) Field of Classification Search ..... 345/76–81, 345/211–214; 315/169.3
See application file for complete search history.

(56) References Cited

U.S. PATENT DOCUMENTS

| | | | | |
|---|---|---|---|---|
| 5,594,463 | A * | 1/1997 | Sakamoto | 345/76 |
| 5,952,789 | A | 9/1999 | Stewart et al. | 315/169.4 |
| 6,518,962 | B1 * | 2/2003 | Kimura et al. | 345/211 |
| 6,633,135 | B1 * | 10/2003 | Nara et al. | 315/169.3 |
| 6,710,548 | B1 * | 3/2004 | Kimura | 315/169.3 |
| 2003/0020413 | A1 * | 1/2003 | Oomura | 315/169.3 |
| 2004/0263499 | A1 * | 12/2004 | Tanada et al. | 345/204 |
| 2005/0190133 | A1 * | 9/2005 | Kawachi | 345/87 |
| 2005/0242746 | A1 * | 11/2005 | Miyagawa et al. | 315/169.3 |
| 2005/0275647 | A1 * | 12/2005 | Numao | 345/204 |

FOREIGN PATENT DOCUMENTS

| | | |
|---|---|---|
| JP | 10-254410 | 9/1998 |
| JP | 11-219146 | 8/1999 |
| JP | 11-338561 | 12/1999 |
| JP | 2000-187467 | 7/2000 |
| JP | 2003-066865 | 3/2003 |
| JP | 2003-076330 | 3/2003 |
| JP | 2003-076331 | 3/2003 |

* cited by examiner

*Primary Examiner*—Amare Mengistu
(74) *Attorney, Agent, or Firm*—Edwards Angell Palmer & Dodge LLP; David G. Conlin; George W. Hartnell

(57) ABSTRACT

A display in accordance with the present invention includes: photoelectric elements as pixels; scan signal lines for sequentially driving the photoelectric elements; video data signal lines for supplying video data signals to the photoelectric elements; and drive-switching elements, each provided for a different photoelectric element, for supplying, to the photoelectric elements, currents matching with the video data signals supplied from the video data signal lines, and further includes path selector switching elements, connected to the respective drive-switching elements, for selecting one of current injecting paths according to a scan signal from the scan signal lines, and a current measuring circuit to either one of the current injecting paths.

18 Claims, 17 Drawing Sheets

ANODE BUFFER LAYER

CuPc

GREEN LIGHT GENERATING LAYER

Alq

RED LIGHT GENERATING LAYER

Alq:HOST

DCM:DOPANT

BLUE LIGHT GENERATING LAYER $Zn(oxz)_2$

HOLE TRANSPORT LAYER

TPD

DISPLAY AND DRIVING METHOD THEREOF

FIELD OF THE INVENTION

The present invention relates to a display, as well as its driving method, in which light-emitting elements for emitting light on supplied current are arranged as pixels to form a matrix.

BACKGROUND OF THE INVENTION

Recent years have seen great effort being put in to actively develop thin displays based on light-emitting devices, such as organic EL (Electro Luminescence) devices and FEDs (Field Emission Devices).

It is known that in light-emitting devices the luminance of an element is proportional to the current density in that element. Such an element is regarded as having characteristics (e.g. applied voltage vs. current characteristics) which are so easy to vary that the luminance can be adjusted through voltage application only with difficulty. Presumably it is preferred if the element is driven using a constant current source.

For example, Japanese Unexamined Patent Application 10-319908/1998 (Tokukaihei 10-319908; published on Dec. 4, 1998, corresponding to U.S. Pat. No. 5,952,789; hereinafter, "Document 1") discloses a technique to apply programmed current levels to organic EL elements (O-LED s) to cause the O-LED s to shine. FIG. 10 illustrates the structure of a pixel in an organic EL display ("pixel structure 100") built based on the technique disclosed in the Application.

The pixel structure 100, as shown in FIG. 10, includes an O-LED 110, two transistors T1, T2, two data lines D1, D2, two select lines S1, S2 and a capacitor C1.

Each of the transistors has a source, gate, drain, and associated electrodes. The source electrode of the first transistor T1 is connected to the data line D1, and the source electrode of the second transistor T2 is connected to the data line D2. The gate electrode of the first transistor T1 is connected to the first select line S1, and the gate electrode of the second transistor T2 is connected to the second select line S2 via the capacitor C1. The drain electrode of the first transistor T1 is connected to the capacitor C1 and also to the gate electrode of the second transistor T2.

The combination of the data lines and the select lines enables the pixel structure 100 to operate in multiple modes including write select mode, write non-select mode, and light-emitting mode.

In write select mode, a predetermined current level (I1) is applied to the O-LED 110 as follows: The first transistor T1 conducts through the first select line S1, allowing the voltage on the first data line D1 to be applied to the gate of the second transistor T2 through the first transistor T1. As the voltage applied to the gate of the second transistor T2 increases, the second transistor T2 conducts and its internal impedance continuously decreases until the current through the second data line D2 reaches the current level I1.

In write select mode, a select signal sent through the second select line S2 stays HIGH. The second data line D2 is connected to the O-LED 110 through the second transistor T2. Therefore, the current level I1 reached flows through both the second transistor T2 and the O-LED 110.

If there exists a shift in the threshold voltage of the second transistor T2 or the transition voltage of the O-LED 110, the shift is accumulated across the capacitor C1 and compensated for by an increase or decrease in the voltage applied to the gate of the second transistor T2.

Thus, whatever shift exists in operating characteristics of either the O-LED 110 or the second transistor T2, or both, the shift hardly affects the current through the O-LED 110, hence the pixel luminance.

In write select mode, the select signal is HIGH on both select lines. In other words, the select signal on the first select line S1 becomes HIGH, causing the first transistor T1 to conduct. The select signal on the second select line S2 on the same row becomes HIGH (that is, write select mode), causing the second transistor T2 to conduct.

However, in write non-select mode, the select signal on the second select line S2 for all the other rows is made LOW (that is, write non-select mode). In other words, in write non-select mode, the second select line S2 is used to cause all the second transistors T2 on all the rows to which no data is written in the array not to conduct.

This is achievable, as shown in FIG. 10, by coupling the second select line S2 to an accumulation terminal through the capacitor C1. When the select signal on the second select line S2 is LOW, in write non-select mode, regardless of the potential accumulated across the capacitor C1, the gate of the second transistor T2 is adapted to receive a LOW signal so as to inhibit current from flowing through the second transistor T2 or the O-LED 110.

Therefore, the current detected along the second data line D2 flows only to selected O-LEDs 110, not to other pixels on that row.

In light-emitting mode, the first select line S1 is made LOW, thereby causing the first transistor T1 not to conduct. Simultaneously, the second select line S2 becomes HIGH. The combination of the HIGH potential on the second select line S2 and the potential stored across the capacitor C1 drives the gate of the second transistor T2 to that adjusted level. By doing this, the O-LED shines at its programmed current levels (that is, as programmed in write select mode) or luminance. In addition, in light-emitting mode, a constant control of the second data line D2 is carried out.

However, since it is difficult to actually assemble a constant current source drive circuit, in many cases a regulated current drive circuit is assembled around a constant voltage source. In such cases, a suggestion is made to provide a means which detects current in the element and to control so that the current detected by the detecting means becomes constant.

An example of an organic EL display which corrects luminance using such a current detecting means is disclosed by Japanese Unexamined Patent Application 2000-187467 (Tokukai 2000-187467; published on Jul. 4, 2000; hereinafter, "Document 2"). The display disclosed (hereinafter, "organic EL panel") is of a passive matrix type including organic EL elements and has a structure shown in FIG. 11.

In FIG. 11, the organic EL panel 201 is made of a matrix of cathodes (C0 to Cn) and anodes (S0 to Sm), as well as organic EL elements located at their crossings and connected to a cathode drive circuit 202 driving the electrodes of the cathodes (C0 to Cn), an anode drive circuit (PG0 to PGm) 203 driving the electrodes of the anodes (S0 to Sn), and a current detecting circuits (IS0 to ISn) 204 detecting an output current from the anode drive circuit.

In other words, the organic EL panel 201 is configured to feed current values detected by the current detecting circuits 204 to a control device 205 so that ON times or ON currents of pixels are adjusted according to the detected currents.

Each current detecting circuit 204 is adapted, as shown in FIG. 12, so as to detect the voltage drop across a resistor (R1) 307 with an A/D converting circuit 306 for output.

Japanese Unexamined Patent Application 11-338561/1999 (Tokukaihei 11-338561; published on Dec. 10, 1999; hereinafter, "Document 3") discloses a display of a passive matrix type having organic EL elements. The display has less current detecting means (current detecting circuits 204). An example of the structure of the passive matrix display is shown in FIG. 13.

Referring to FIG. 13, the passive matrix display has an organic EL panel 401 in which light-emitting elements Z11 to Znn are connected to the crossings of row electrodes R1 to Rn and column electrodes C1 to Cn.

Row drivers 421 to 42*n* driving the column electrodes C1 to Cn are connected to a current detect resistor Rd connected to a separate operating power source VB1 from the row electrodes R1 to Rn and sequentially addressed by selector circuits S11 to S1*n*. The column electrodes C1 to Cn in the matrix are connected to those terminals of the selector circuits S11 to S1*n* which are not connected to the current detect resistor Rd.

The voltage across the current detect resistor Rd is compared with a reference voltage Vref by a differential amplifier A1 and an error amplifier A2, inverted and amplified, and fed back to the inputs of constant current drive circuits 421 to 42*n* forming a row driver. Under these circumstances, the column electrodes C1 to Cn are sequentially connected to the current detect resistor Rd for current correction; the rows therefore do not need individual current detecting/correcting circuits, but can share a single, common circuit.

An example of an organic EL display which corrects luminance using such a current detecting means together is disclosed by Japanese Unexamined Patent Application 10-254410/1998 (Tokukaihei 10-254410; published on Sep. 25, 1998; hereinafter "Document 4"). The display disclosed is of an active matrix type including organic EL elements. FIG. 14 shows a block diagram of the active matrix display.

Referring to FIG. 14, the active matrix display includes an A/D converting circuit 511, computing circuit 512, frame memory 513, controller 514, scan circuit 515, write circuit 516, current circuit 517, current value memory 518, and display panel 519.

Still referring to FIG. 14, a luminance adjusting means drives all organic EL elements in the display panel 519 at a common, constant voltage, measures the current in each organic EL element, stores the measured current value in the current value memory 518, causes the computing circuit 512 to process that memory data and the display data externally fed through the A/D converting circuit 511, and adjusts the sum value of the currents through the pixels.

To achieve an active drive, each pixel in the display panel 519 has a structure illustrated in FIG. 15. Addressing a scan electrode line causes the FET 621 to conduct, storing the voltage on the data electrode line in the capacitor 623. Even when the FET 621 does not conduct, the FET 622 is controlled by way of the voltage across the capacitor 623 so as to adjust the current value through the organic EL 625.

Accordingly, the current detector 624 is placed between the FET 622 and the organic EL element 625. An A/D converting circuit 626 digitizes the output from the current detector 624 to produce digital data, which is stored in the current value memory 627 to adjust the sum of the current values.

However, in the passive matrix display disclosed in Document 2 (Tokukai 2000-187467), since the cathodes (C0 to Cn) are sequentially selected, the current through the organic EL element located at the crossing of the selected cathode (scan electrode line Ci) and the anode (signal electrode line Sj) can be measured by measuring the current through the anode (signal electrode line Sj). In the passive matrix display disclosed in Document 3 (Tokukaihei 11-338561), the current through the organic EL element can be measured by measuring the current through the associated column electrode (C1 to Cn).

However, in these passive matrix displays in Documents 2, 3, only those pixels which are connected to the currently selected electrodes shine, and the pixels do not shine in most of the non-select periods. Accordingly, to achieve a HIGH of overall luminance, the selected pixels must shine with extremely high luminance. For example, where the duty ratio is 1/100, an instantaneous luminance of $100\times100=10000$ cd/m$^2$ is required in a select period to achieve a mean luminance of 100 cd/m$^2$. Achieving such a high instantaneous luminance necessitates application of high voltage to the selected electrode, which is in general cases disadvantageous in terms of light emitting efficiency.

Meanwhile, the active matrix display disclosed in Document 1 (Tokukaihei 10-319908) goes through write select mode, write non-select mode, and then light-emitting mode, and therefore fails to produce expected luminance in a no-light-emitting period which inevitably occurs in a scan frame period, although the problem is not as serious as in the case of passive matrix displays.

In the active matrix display disclosed in Document 4 (Tokukaihei 10-254410), current flows through the organic EL element even when the associated scan electrode line is not being selected. Therefore, the display does not require as much instantaneous luminance as the passive matrix display. However, the aforementioned organic EL element current measuring method for passive matrix displays, that is, the collective current measurement for each signal lines in Document 2, does not work with active matrix displays.

Accordingly, in active matrix displays, current is measured for each pixel as shown in FIG. 15.

The illustrated arrangement, in which a separate current measuring means is provided for each pixel, has problems of a low TFT (Thin Film Transistor) integration in each pixel and a low aperture ratio of the panel due to the placement of the current measuring means with each pixel.

SUMMARY OF THE INVENTION

The present invention has an object to offer a display, together with its driving method, capable of producing a uniform display, almost free from aperture ratio reductions and no-light-emitting periods, and enabling the provision of current measuring instruments without reducing the panel aperture ratio.

To achieve the objectives, a display in accordance with the present invention is a display in which multiple light-emitting elements which emit light on a current supply are provided as pixels, and is characterized in that it includes: scan signal lines for sequentially driving the light-emitting elements; video data signal lines for supplying video data signals to the light-emitting elements; drive-switching elements, each provided for a different respective light-emitting element, for supplying, to the light-emitting elements, currents matching with the video data signals supplied from the video data signal lines; multiple current supply paths for supply currents to the light-emitting elements; and path selector switching elements, connected to the respective drive-switching elements, for selecting one of the current supply paths according to a scan signal from the scan signal lines.

According to the arrangement, path selector switching elements for selecting one of the current supply paths for supplying currents to light-emitting elements according to a scan signal from scan signal lines are connected to drive-switching elements connected to respective light-emitting elements; therefore, switching controls of the current supply paths become possible for each light-emitting element (pixel).

The arrangement enables, for example, the use of a different current supply path for supplying current to a pixel when the pixel is being selected during scanning and when the pixel is not being selected during scanning; therefore, the pixel is fed with current even when the pixel is being not selected during scanning. Accordingly, unlike passive matrix displays in which no current flows through pixels when they are not selected during scanning, the display of the invention does not require high instantaneous luminance, and hence high voltage application to the pixels, and improves the luminous efficiency of the entire display.

Further, a different current supply path is used to supply current to a pixel when the pixel is being selected during scanning and when the pixel is not being selected during scanning. This enables, for example, measurement and correction of the current supply to the pixel when it is being selected for scanning, regardless of the light emission state of the non-selected pixel, provided that a current measuring circuit and a correction circuit for adjusting the sum of the current flow to the pixels are disposed only to the current supply path that supplies current to the pixel when selected during scanning.

In this case, a current measuring circuit and a correction circuit are disposed for each column electrode (video data signal line). Therefore, unlike conventional active matrix displays, the display of the invention does not require the provision of a current measuring circuit for measuring a current flow to a pixel and a correction circuit for each pixel, and prevents a reduction in aperture ratio of a pixel due to the current measuring circuit and the correction circuit. Thus, in comparison to cases where a current measuring circuit and a correction circuit are provided for each pixel, the display is able to produce a bright image at a low voltage.

To achieve the objectives, a method of driving the display is characterized in that a different current supply path which is a current supply path to a light-emitting element is used during a scan period during which the light-emitting element is being driven and a time period other than the scan period.

The arrangement enables current supply to the light-emitting elements during both a scan period and a non-scan period. For example, a different current supply path can be used to supply current to a pixel during scan select period and during scan non-select period. As a result, current flows through the pixel even during scan non-select period. Accordingly, in comparison to cases where current does not flow through the pixels during scan non-select period like in passive matrix displays, the method of the invention does not require high instantaneous luminance, and hence high voltage application to the pixels, and improves the luminous efficiency of the entire display.

For these reasons, the present invention enables the mounting of the current measuring instruments without a reduction in aperture ratio and the offering of displays that produce no irregularities, no reduction in aperture ratio, and almost no no-light-emitting period.

For a fuller understanding of the nature and advantages of the invention, reference should be made to the ensuing detailed description taken in conjunction with the accompanying drawings.

DESCRIPTION OF THE EMBODIMENTS

[Embodiment 1]

The following will describe an embodiment in accordance with the present invention. Although dealing with an organic EL display incorporating organic EL elements as light-emitting devices, the embodiment is by no means limiting the invention which is also applicable to any types of displays incorporating photoelectric elements adjusting luminance according to elements' current values, including the field emission display (FED).

The present embodiment will also describe an active matrix organic EL display as an organic EL display, because as already mentioned, with organic EL elements and other current-driven optical elements whose luminance is proportional to the current density therethrough, an active matrix structure in which each pixel has its own active element is advantageous over a passive (simple) matrix structure for better luminous efficiency and lower voltage.

In addition, in an active matrix structure, drivers and other TFT-based devices can be mounted on the same board as the display elements. The feature will contribute to compactness and cost reduction.

Figure 2:
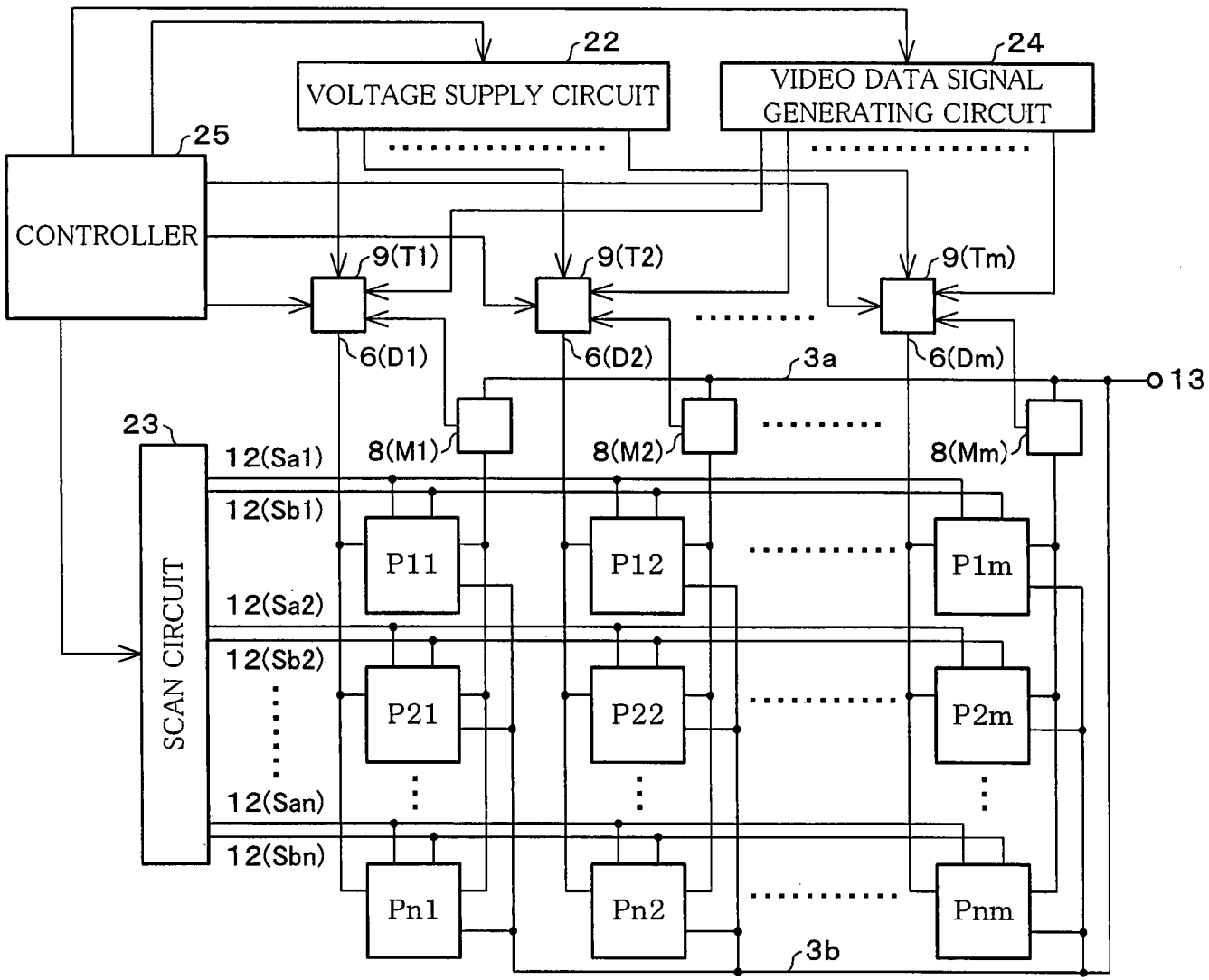
FIG. 2 is a schematic block diagram of a display incorporating pixels and their environs arranged as illustrated in FIG. 1.

Referring to FIG. 2, the organic EL display of the present embodiment includes scan signal lines 12 and video data signal lines 6 which are positioned to form a matrix, and pixels P11 to Pnm, each complete with a current-driven optical element and an active element, which are located at the crossings of the two kinds of signal lines.

In the organic EL display illustrated in FIG. 2, every two of the scan signal lines 12 are paired up together: the pair of scan signal lines 12 associated with the pixels P11, P12, . . . , and P1*m* is denoted by Sa1 and Sb1, and the pair associated with the pixels Pn1, Pn2, . . . , and Pnm by San and Sbn. Similarly, the video data signal line 6 associated with the pixels P11, P21, . . . , and Pn1 are denoted by D1, and that associated with the pixels P1*m*, P2*m*, . . . , and Pnm by Dm. Each video data signal line 6 is connected to a voltage supply circuit 22 through a different voltage setting circuit 9. The scan signal lines 12 are connected to a scan circuit 23.

Each pixel is connected to two current injecting paths 3*a*, 3*b* which are in turn connected to a current source 13. On one of the current injecting paths, 3*a*, there are provided current measuring circuits 8 between the current source 13 and pixels. The current values obtained by means of the current measuring circuits 8 are converted into voltage values and fed to the voltage setting circuits 9. The voltage setting circuits 9 then compare the voltage values corresponding to the current values with the video data signal voltage values received from a video data signal generating circuit 24 and adjust the voltage application to the video data signal lines 6 by the voltage supply circuit 22 until the current value data (voltage values) given by the current measuring circuits 8 reach values matching with video data signals for the pixels currently being addressed.

Note that the current measuring circuit 8 associated with the pixels P11, P21, . . . , and Pn1 is denoted by M1, and that associated with the pixels P1*m*, P2*m*, . . . , and Pnm by Mm. Similarly, the voltage setting circuit 9 associated with the pixels P11, P21, . . . , and Pn1 is denoted by T1, and that associated with the pixels P1*m*, P2*m*, . . . , and Pnm by Tm. In total, the number of the current measuring circuits 8 and that of the voltage setting circuits 9 are both equal to that of the video data signal lines 6.

A controller 25 controls the scan circuit 23, the voltage supply circuit 22, and the video data signal generating circuit 24. In the present embodiment, the scan circuit 23, the voltage supply circuit 22, the voltage setting circuits 9, the current measuring circuits 8, the video data signal generating circuit 24, and the controller 25 are provided separately from, but connected to, the board on which the pixels are fabricated. Alternatively, all or any of these components may be fabricated on the same board with the pixels using TFT technology.

Now, referring to FIG. 1, the pixels in the organic EL display will be described in terms of structure in more detail.

Figure 1:
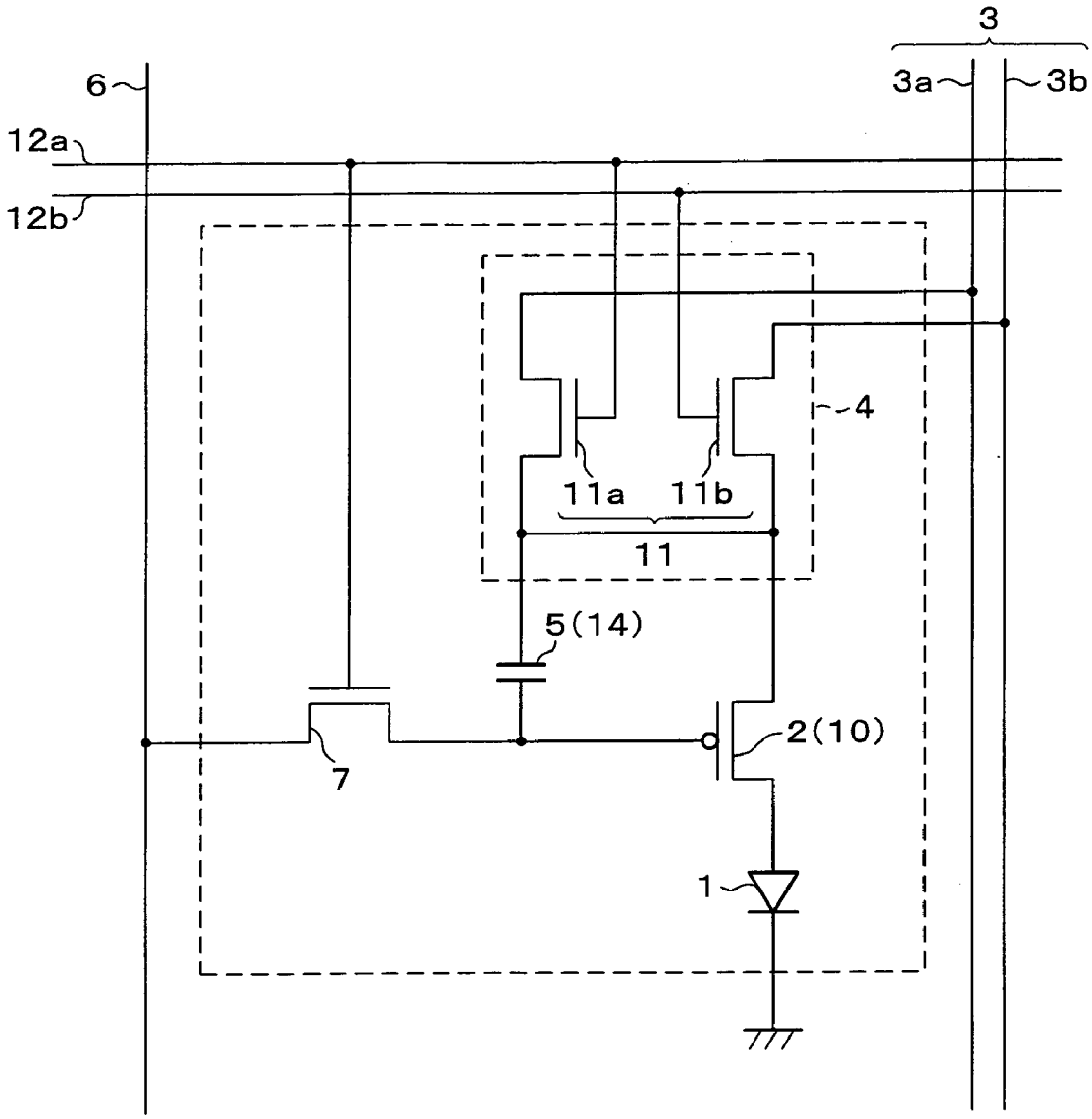
FIG. 1 is a schematic diagram of a pixel in a display in accordance with the present invention.

As shown in FIG. 1, each pixel includes as a photoelectric element 1 an organic EL element which is connected in series to a drive-switching element 2 built around a p-type FET 10. Potential holding means 5 (holding capacitor 14) is connected to the drive-switching element 2. A scan switching element 7 for providing a video data signal from the video data signal line 6 to the potential holding means 5 in accordance with the scan action using the scan signal lines 12 is formed using an n-type FET and connected to the potential holding means 5 and the drive-switching element 2.

One of the current injecting paths 3*a*, 3*b* to the pixel is selectable by means of the path selector switching element 4. In other words, the current injecting paths 3*a*, 3*b* are adapted for switching between them.

The current injecting path 3*a* is connected to the current source 13 and the current measuring circuits 8; the current injecting path 3*b* is connected to the current source 13 (see FIG. 2). Each video data signal line 6 is connected to a voltage setting circuit 9 which compares the measured value of the current from the current measuring circuit 8 with the video data signal voltage supplied for the associated pixel from the video data signal generating circuit 24 and specifies the voltage applied to the video data signal line 6.

Still referring to FIG. 1, the p-type FET 10, constituting the drive-switching element 2, is connected to the photoelectric element 1 at the drain terminal, the path selector switching element 4 at the source terminal, and the potential holding means 5 and the scan switching element 7 at the gate electrode.

Figure 16:
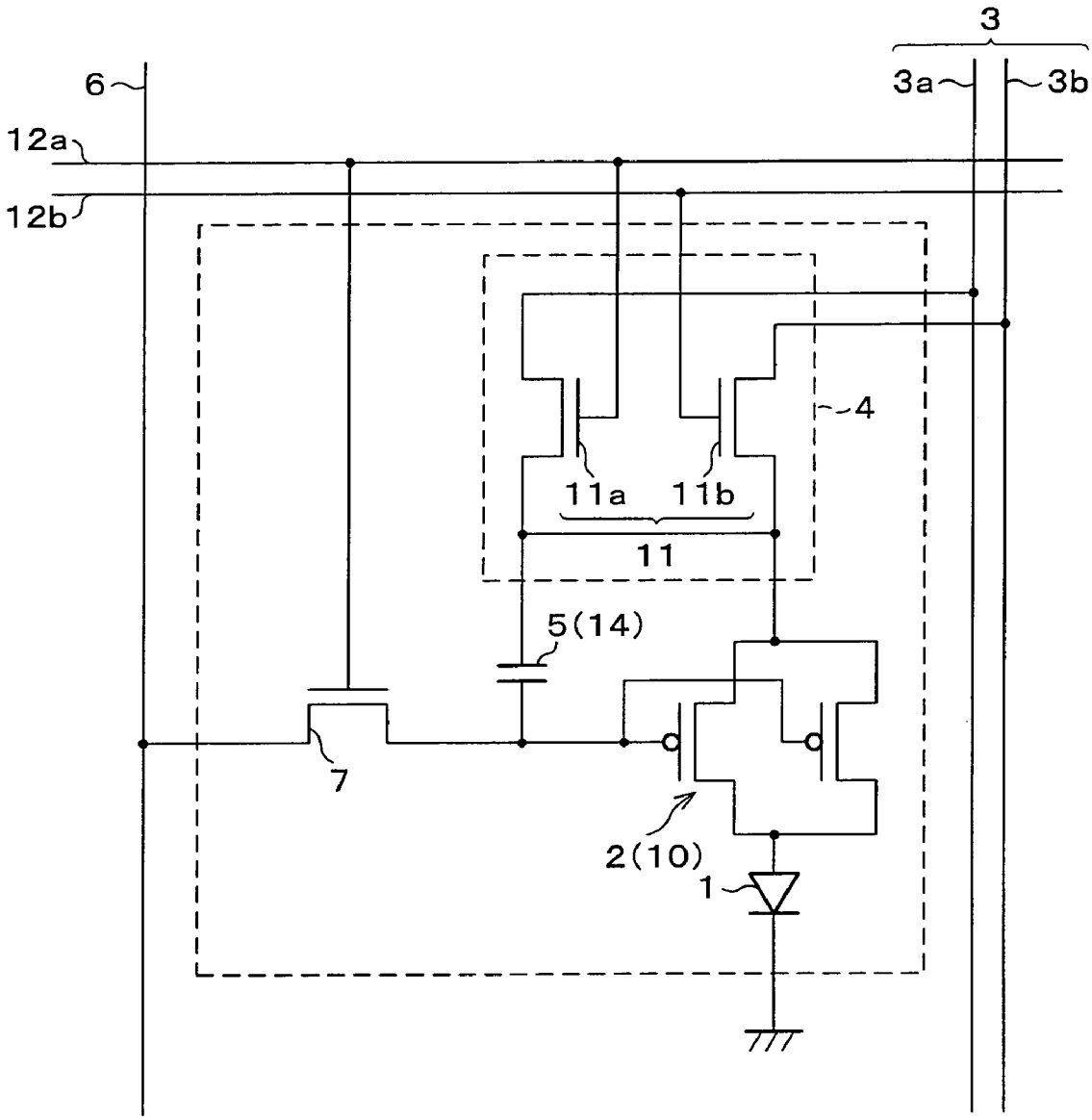
FIG. 16 is another schematic diagram of a pixel in a display in accordance with the present invention.

When the photoelectric element 1 requires such a great current that exceeds the supply capability of the drive-switching element 2 built around a single FET 10, the drive-switching element 2 could be built including two or more FETs 10 connected in parallel as in FIG. 16 showing such a pixel. In this example, the drive-switching element 2 includes two FETs 10 and is capable of supplying greater current to the photoelectric element 1 than in the case involving a single FET 10.

The path selector switching element 4 includes two n-type transistors (FETs) 11*a*, 11*b*. The FETs in the path selector switching element 4 need to be provided at least in the same number as the switched current injecting paths; in the example in FIG. 1, there are two FETs constituting the path selector switching element 4 to enable selection between the two current injecting paths 3*a*, 3*b*.

Each FET 11*a*, 11*b* is connected to the drive-switching element 2 at the drain terminal, the associated one of the current injecting paths 3*a*, 3*b* at the source terminal, and the associated one of the scan signal lines 12*a*, 12*b* at the gate terminal. In FIG. 1, the source and gate terminals of the FET 11*a* are connected to the current injecting path 3*a* and the scan signal line 12*a* respectively, and those of the FET 11*b* are connected to the current injecting path 3*b* and the scan signal line 12*b* respectively.

Figure 3:
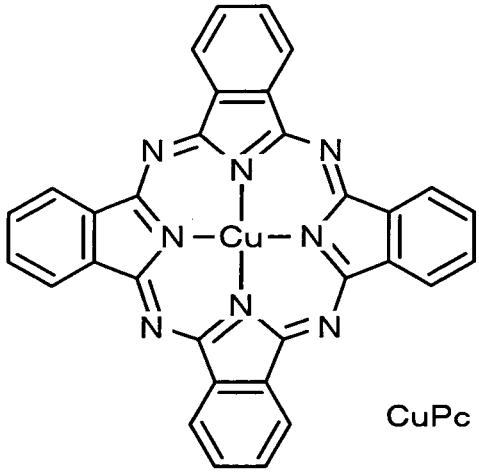
FIG. 3 shows structural formulae of essential components of a photoelectric element in the pixel in FIG. 1.
Figure 3:
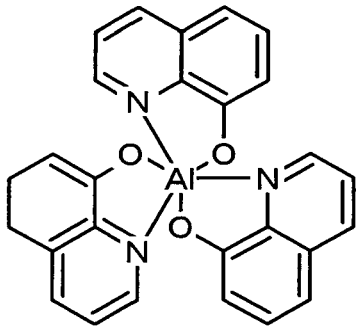
Figure 3:
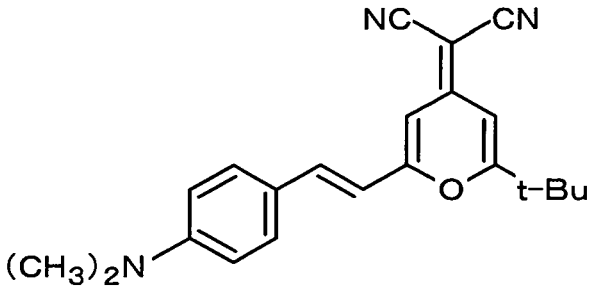
Figure 3:
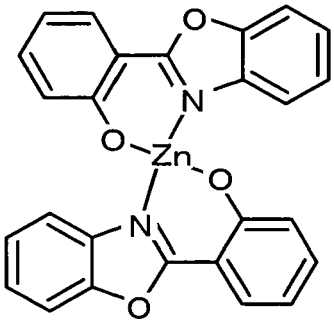
Figure 3:
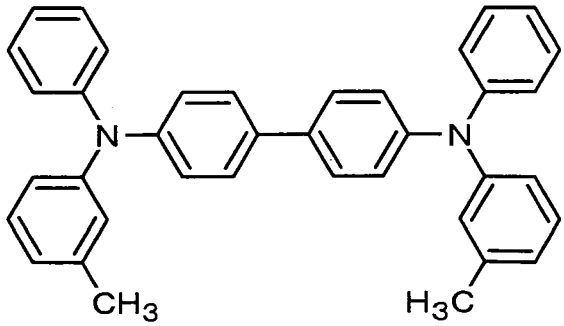

An organic EL layer used as the photoelectric element 1 is made of, for example, a TFT-carrying glass board, transparent ITO anodes provided thereon, multiple organic layers provided thereon, and Al cathodes provided thereon. The structure of the multiple organic layers may vary, and in the present embodiment includes a hole injection layer (or anode buffer layer) (CuPc), light-emitting layers (green, Alq; red, Alq doped with DCM; blue, Zn(oxz)2), a hole transport layer (TPD), and an electron transport layer (Alq), deposited in this order. FIG. 3 shows the layers' individual structures.

Here, transparent electrodes are provided on the side of the glass board so that light emission is observable on the glass board side. Alternatively, light emission may be observed on the opposite side of the board by forming an opaque electrode (metal electrode) on the TFT-carrying board, multiple organic layers thereon, and transparent electrodes further thereon.

The current measuring circuit 8 measures the current through the current injecting path 3*a* as a voltage. A resistor element and an op-amplifier are provided to convert a current value to a matching voltage value, monitoring a voltage drop across the resistor element due to the current flow therethrough. The output voltage is transmitted to the voltage setting circuit 9.

Figure 4:
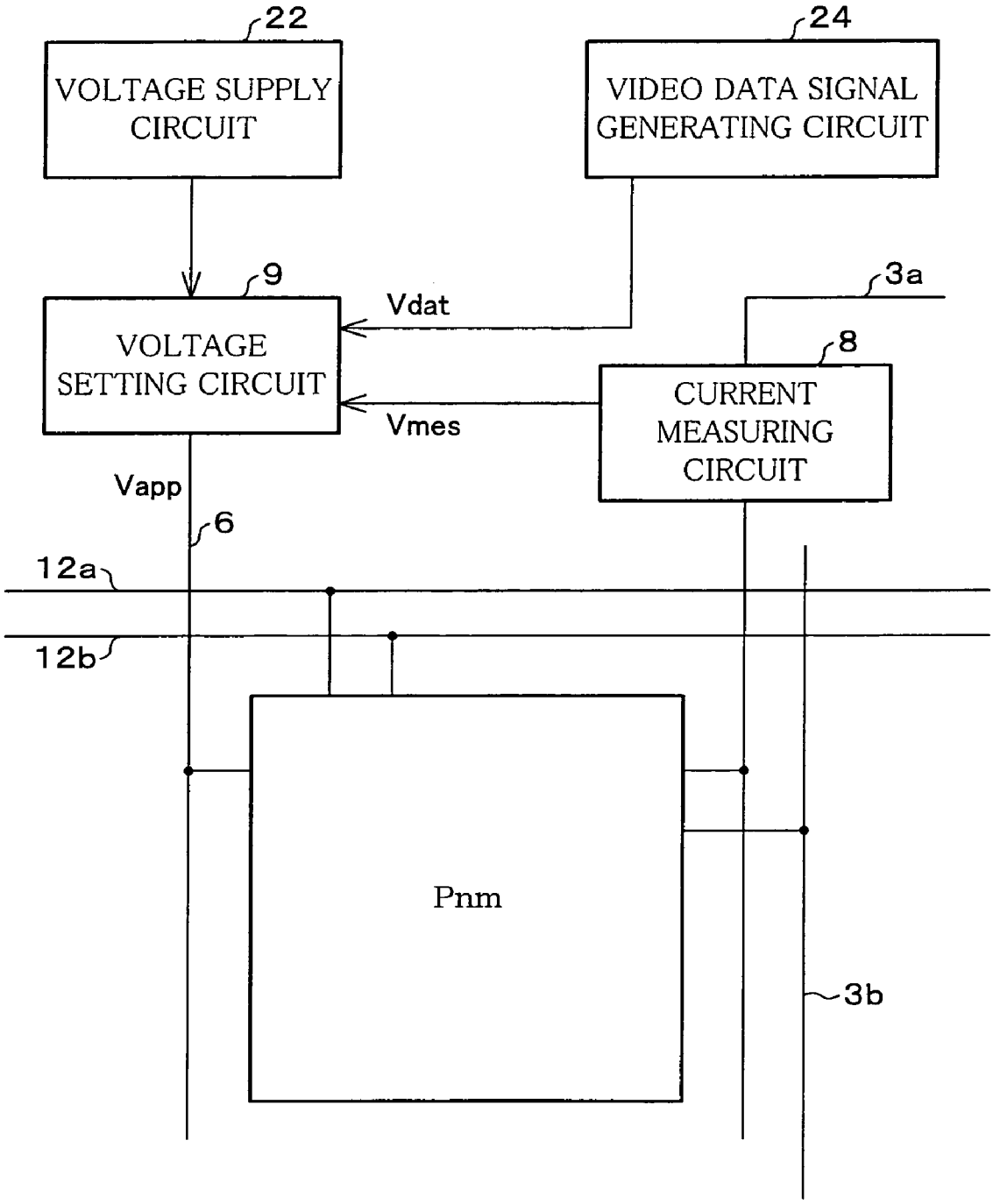
FIG. 4 is an illustrative drawing showing a circuit arrangement to supply voltage and data signals to the pixel in FIG. 1.

The following will describe operations of the voltage setting circuit 9 in reference to FIG. 4.

As shown in FIG. 4, the voltage setting circuit 9 compares a voltage Vdat, received from the video data signal generating circuit 24, which corresponds to the video data signal (tone signal) for the selected pixel Pnm with a voltage Vmes, received from the current measuring circuits 8, which corresponds to the current flow in the selected pixel Pnm, so as to adjust the voltage supplied from the voltage supply circuit 22, that is, the applied voltage Vapp to the pixel Pnm via the video data signal line 6.

Figure 5:
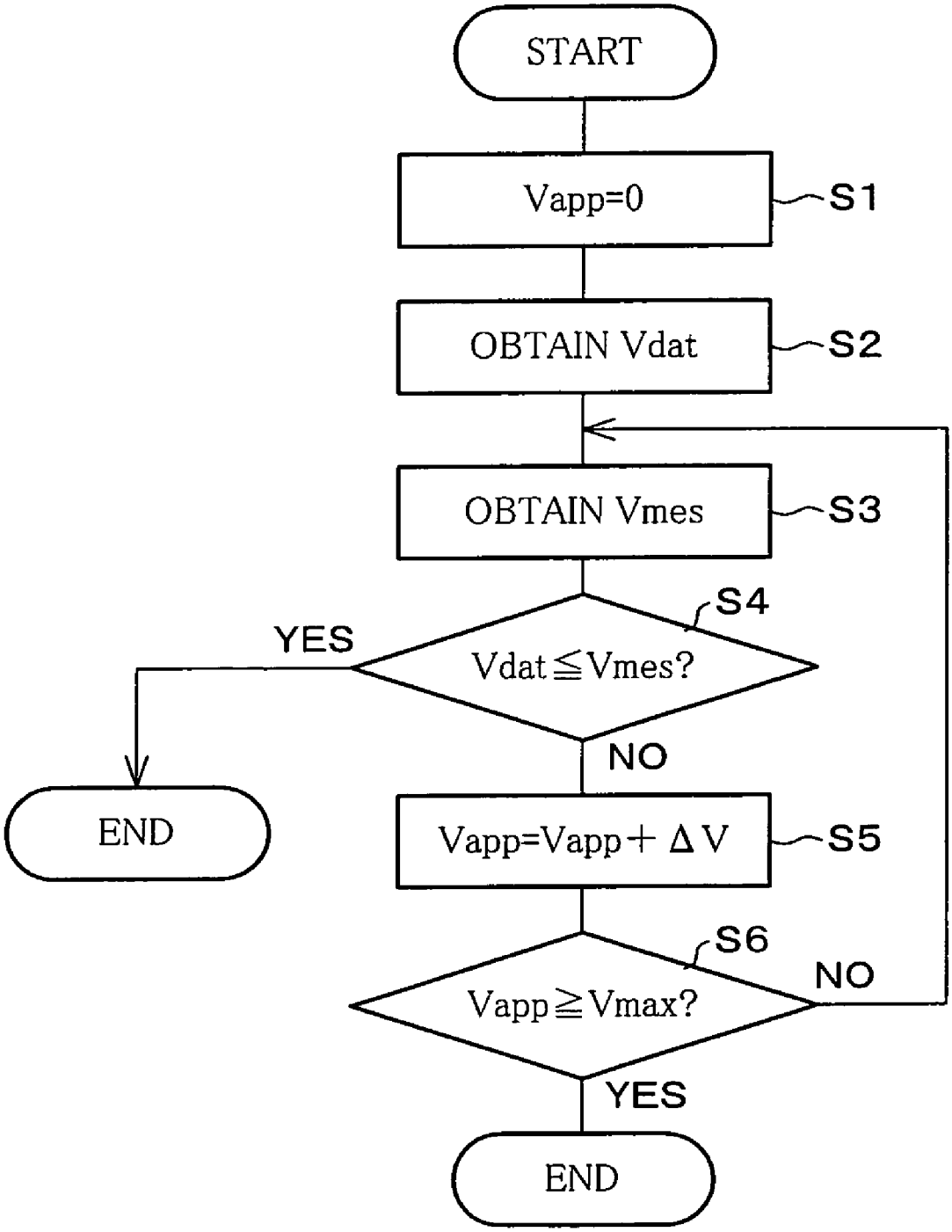
FIG. 5 is a flow chart showing the sequence of operations of the circuits in FIG. 4.

Here, the voltage setting circuit 9 is built around a logic circuit of which the operation flow is shown in FIG. 5. A basic operation is to adjust the voltage Vapp applied to the pixel via the video data signal line 6 continuously until the voltage Vmes, which matches with the current flow through the pixel, equals the voltage Vdat corresponding to the video data signal.

First, as shown in FIG. 5, the voltage setting circuit 9 initializes Vapp to V0 (0 in this example) (step S1) and acquires Vdat from the video data signal generating circuit 24 (step S2) and Vmes from the current measuring circuits 8 (step S3).

The circuit 9 then determines whether Vdat≦Vmes (step S4). If Vdat≦Vmes, the circuit 9 ends the process and applies that Vapp to the video data signal line 6.

If Vdat>Vmes in step S4, the circuit 9 increases Vapp by a predetermined value ΔV (step S5) and compares Vdat with Vmes again to see whether Vapp≧Vmax (step S6), where Vmax is the value of Vapp causing the pixel to produce a maximum luminance.

In step S6, if Vapp≧Vmax, the circuit ends the process and sets Vapp to Vmax to apply the voltage to the video data signal line 6.

If Vapp<Vmax in step S6, the circuit performs step S3 to acquire Vmes again from the current measuring circuit 8. This process is repeated until Vdat≦Vmes. In the operation, the smaller ΔV, the more detailed the adjustment of Vapp; however, ΔV may be typically determined depending on the number of tones of the display. For example, to enable each pixel to display 256 tones, ΔV is preferably set to about (Vmax−V0)/256/2.

The applied voltage Vapp to the video data signal line 6 for the associated pixel can be set so that a current which matches with the video data signal would flow in the pixel.

Figure 6:
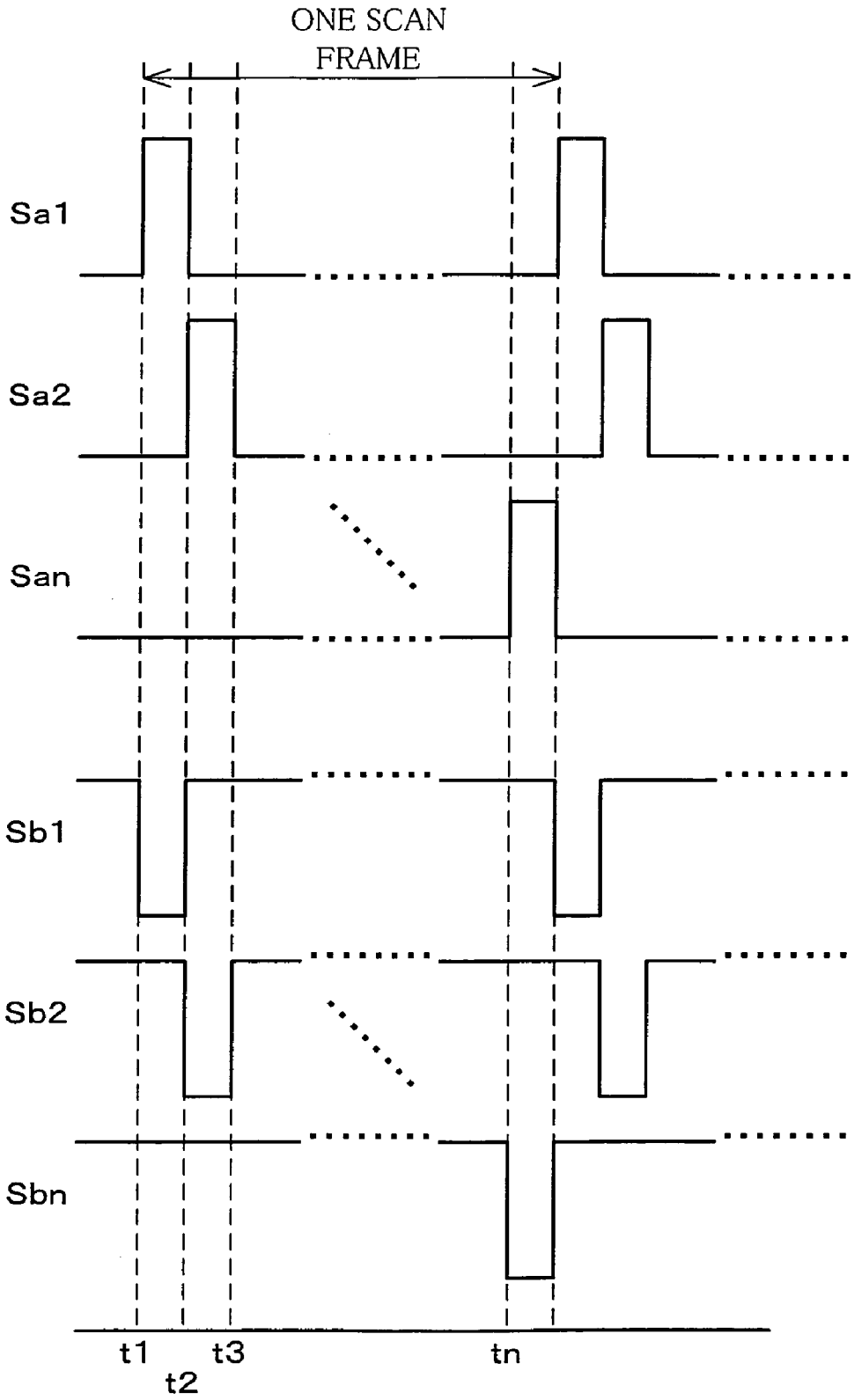
FIG. 6 is a waveform chart showing scan signals in the display depicted in FIG. 2.

FIG. 6 shows as an example a drive waveform of the organic EL display illustrated in FIGS. 1, 2. In FIG. 6, Sa1, Sa2, and San represent the scan signal voltages applied to the scan signal lines Sa1, Sa2, and San (12) in FIG. 2. Likewise, Sb1, Sb2, and Sbn in FIG. 6 represent the scan signal voltages applied to the scan signal lines Sb1, Sb2, and Sbn (12).

The organic EL display thus structured is scanned, that is, the scan signal lines Sa1, Sa2, . . . , and San and Sb1, Sb2, . . . , and Sbn are selected line by line (scanned) within one scan frame. When selected, the scan signal lines Sa1, Sa2, . . . , and San are HIGH and the scan signal lines Sb1, Sb2, . . . , and Sbn are LOW. When not selected, the signals are inverted: the scan signal lines Sa1, Sa2, . . . , and San are LOW and the scan signal lines Sb1, Sb2, . . . , and Sbn are HIGH.

In FIG. 6, at a point in time t1, Sa1 and Sb1, and hence the pixels P11, P12, . . . , and P1*m*, are selected with the other scan signal lines not selected. This period is the scan period for the pixels P11, P12, . . . , and P1*m*.

Still referring to FIG. 6, during the period between t1 and t2 (scan period for the pixels P11, P12, . . . , and P1*m*), Sa1 is HIGH, and Sb1 is LOW. Thus, in each of the pixels P11, P12, . . . , and P1*m*, the FET 11*a* conducts and the FET 11*b* does not conduct, electrically coupling the drive-switching element 2 and the photoelectric element 1 to the current source 13 via the current injecting path 3*a* (see FIG. 1).

In the pixels other than P11, P12, . . . , and P1*m*, the FET 11*a* does not conduct and the FET 11*b* conducts, electrically coupling the drive-switching element 2 and the photoelectric element 1 to the current source 13 via the current injecting path 3*b*.

The current injecting path 3*a* is coupled to the current measuring circuits 8 where the current values in the selected pixels can be measured sequentially. Because current is supplied to the non-select pixels via the other current injecting path 3*b*, the current values in the selected pixels can be measured sequentially without being adversely affected by the current flows through the non-select pixels.

Only in the pixels P11, P12, . . . , and P1*m*, does the scan switching element 7 conduct, allowing the voltage on the video data signal line 6 to be applied to the drive-switching element 2. In the other pixels, the scan switching element 7 does not conduct, electrically isolating the video data signal line 6 from the drive-switching element 2.

During the period between t1 and t2, video data is written to, and held by, the selected pixels P11, P12, . . . , and P1*m*.

In the organic EL display thus structured, as shown in FIGS. 1, 2, the voltage supply circuit 22 supplies signal voltage which is applied to the video data signal lines 6 associated with the pixels via the respective voltage setting circuits 9. Under these circumstances, the current values from the current injecting path 3*a* through the pixels are sequentially measured by the current measuring circuits 8 where the current measurements are converted to voltage values before being transmitted to the voltage setting circuits 9.

Each voltage setting circuit 9 then compares the incoming value with the video data voltage received, as a video data signal, from the associated video data signal generating circuit 24 and specifies the applied voltage to the video data signal line 6 so that the current flow through the pixel has a value which corresponds to the video data signal. The voltage is applied to the gate terminal of the drive-switching element 2 via the conducting scan switching element 7, so as to control an injection current to the photoelectric element 1.

Specifying the applied voltage to the video data signal line 6 in reference to the current value through the pixel in this manner can achieve constant luminance corresponding to the video data signal regardless of potential aging and irregularity in characteristics among the switching elements and the photoelectric elements 1 constituting the pixels. Under these circumstances, the applied voltage to the video data signal line 6 is not only applied to the drive-switching element 2 via the scan switching element 7, but also stored by the potential holding means 5.

The subsequent period between t2 and t3 in FIG. 6 is allocated for the scanning of the pixels P21, P22, . . . , and P2*m*. During the period, the scan signal lines Sa2, Sb2 corresponding to the pixels P21, P22, . . . , and P2*m* are selected, and the other scan signal lines are not selected. That is, Sa2 is HIGH and Sax is LOW (x=1 to n except for 2), and Sb2 is LOW and Sbx is HIGH (x=1 to n except for 2).

In the previously selected pixels P11, P12, . . . , and P1*m*, the scan switching element 7 now no longer conducts, cutting off the voltage application from the video data signal line 6 to the pixel. Nevertheless, the drive-switching element 2 remains conducting due to the charge buildup in the potential holding means 5 during the period between t1 and t2. Therefore, in the pixels P11, P12, . . . , and P1*m*, the FET 11*a* remains not conducting, and the FET 11*b* remains conducting, allowing current to flow from the current injecting path 3*b* to the photoelectric element 1 in accordance with the conducting state of the drive-switching element 2.

In this manner, in P11, P12, . . . , and P1*m*, the pixel current specified during the select period continues to flow even in the non-select period. The pixel current, and hence luminance, can be maintained at a substantially constant value until the pixel is selected next time in the subsequent frame.

During this period starting at t2 and ending at t3, in the pixels P21, P22, . . . , and P2*m*, the FET 11*a* conducts and the FET 11*b* does not conduct; in the other pixels, the FET 11*a* does not conduct and the FET 11*b* conducts. That is, in the pixels P21, P22, . . . , and P2*m*, the drive-switching element 2 and the photoelectric element 1 are coupled to the current source 13 via the current injecting path 3*a*; in the other pixels, the elements 1, 2 are coupled to the current source 13 via the current injecting path 3*b*. Consequently, as to the currently selected (scanned) pixels P21, P22, . . . , and P2*m*, the current measuring circuit 8 can measure the pixel current value through the current injecting path 3*a*, independently from the non-select pixels.

Under these circumstances, similarly to the period between t1 and t2, the voltage supply circuit 22 applies a signal voltage to the currently selected pixels P21, P22, . . . , and P2*m* via the respective voltage setting circuits 9 and video data signal lines 6. Under these circumstances, the current values from the current injecting path 3*a* through the pixels are sequentially measured by the current measuring circuits 8 where the current measurements are converted to voltage values before being transmitted to the voltage setting circuits 9. Each voltage setting circuit 9 then compares the incoming value with the video data signal voltage across the pixel received from the associated video data signal generating circuit 24 and specifies the applied voltage to the video data signal line 6 so that the current flow through the pixel has a value which corresponds to the video data signal. The applied voltage to the video data signal line 6 is applied to the drive-switching element 2 via the scan switching element 7, so as to control the current through the photoelectric element 1. Concurrently, the applied voltage to the video data signal line 6 is stored by the potential holding means 5.

During the period t3, the scan signal lines Sa2, Sb2 corresponding to the pixels P21, P22, . . . , and P2*m* are not selected, isolating the pixels from the video data signal lines 6. However, similarly to the pixels P11, P12, . . . , and P1*m*, the charge buildup in the potential holding means 5 continues to control the drive-switching element 2, keeping the luminance of the photoelectric element 1 at a predetermined value.

Similarly, P31, P32, . . . , and P3*m* are selected during the period starting at t3, and then P41, P42, . . . , and P4*m* are selected during the period starting at t4. The process is repeated line by line until the Pn1, Pn2, . . . , and Pnm are selected during the period starting at tn, which completes the writing of video data to all the pixels, ending one scan frame. Repeating that scan frame enables an image to be continuously produced.

The use of the organic EL display and its driving method successfully produces bright images with no display irregularity.

[Embodiment 2]

The following will describe another embodiment in accordance with the present invention. Similarly to embodiment 1, the present embodiment will describe an active matrix organic EL display. Therefore, members of the present embodiment that have the same arrangement and function as members of embodiment 1, and that are mentioned in that embodiment are indicated by the same reference numerals and description thereof is omitted.

Figure 7:
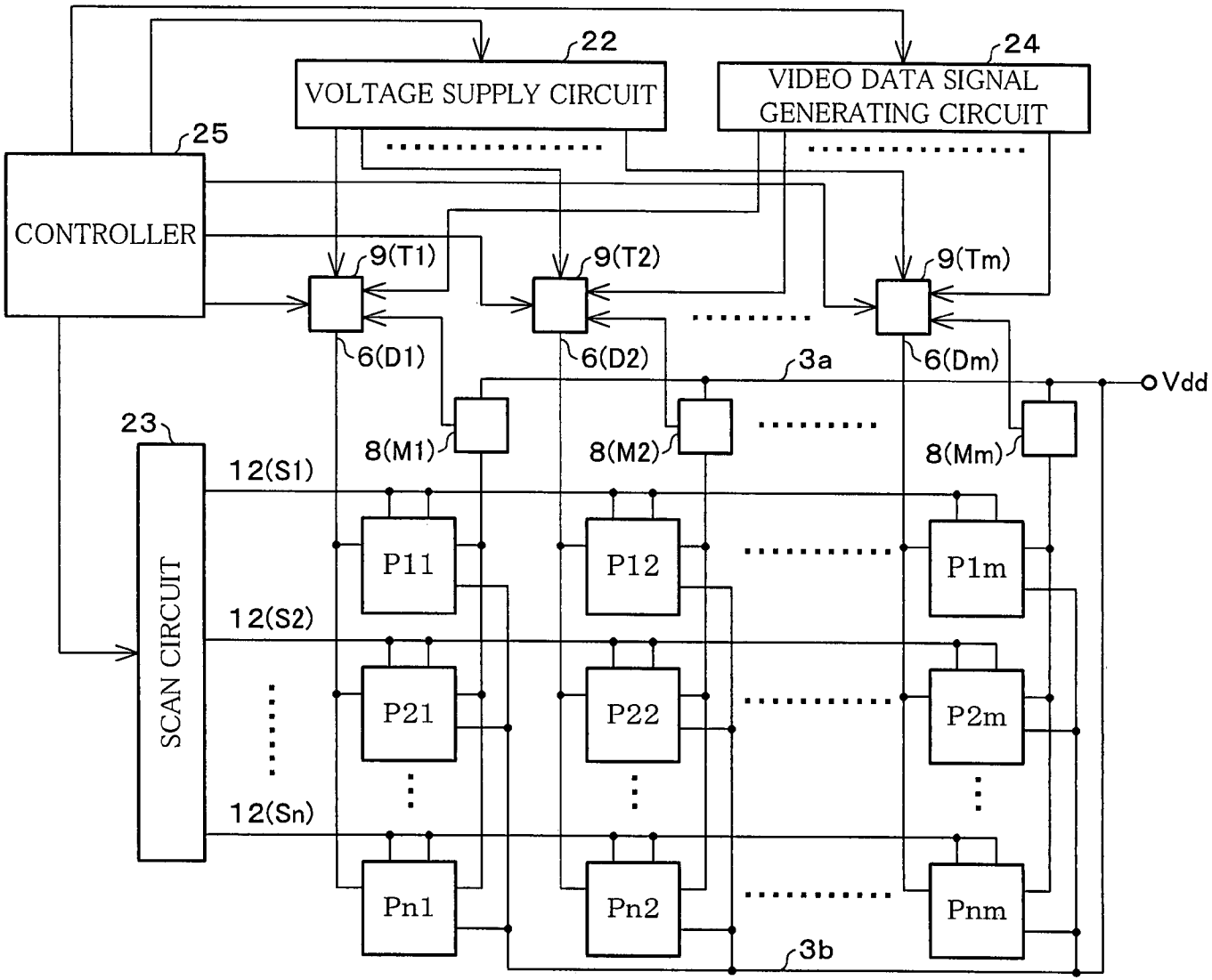
FIG. 7 is a schematic block diagram of a display of another embodiment in accordance with the present invention.

Referring to FIG. 7, the organic EL display of the present embodiment includes scan signal lines 12 and video data signal lines 6 which are positioned to form a matrix, and pixels P11 to Pnm, each complete with a photoelectric element 1 and an active element, which are located at the crossings of the two kinds of signal lines, similarly to those in the organic EL display of embodiment 1 (see FIG. 2).

In the organic EL display illustrated in FIG. 7, the scan signal line 12 associated with the pixels P11, P12, . . . , and P1*m* is denoted by S1, and the associated with the pixels Pn1, Pn2, . . . , and Pnm by Sn. Similarly, the video data signal line 6 associated with the pixels P11, P21, . . . , and Pn1 is denoted by D1, and that associated with the pixels P1*m*, P2*m*, . . . , and Pnm by Dm. Note that each pixel is connected to a pair of scan signal lines 12 in the organic EL display of embodiment 1, whereas each pixel is connected to only one scan signal line 12 in the organic EL display of the present embodiment.

Each video data signal line 6 is connected to a voltage supply circuit 22 via a voltage setting circuit 9. Each scan signal line 12 is connected to a scan circuit 23. Each pixel is connected to two current injecting paths 3*a*, 3*b* which are in turn connected to a current source Vdd. On one of the current injecting paths, 3*a*, there are provided current measuring circuits 8 between the current source Vdd and pixels.

The current values obtained by means of the current measuring circuits 8 are converted into voltage values and fed to the voltage setting circuits 9. The voltage setting circuits 9 then compare the voltage values corresponding to the current values with the video data signal voltage values received from a video data signal generating circuit 24 and adjust the voltage application to the video data signal lines 6 by the voltage supply circuit 22 until the current value data given by the current measuring circuits 8 reach values matching with video data signals for the pixels currently being addressed.

A controller 25 controls the scan circuit 23, the voltage supply circuit 22, and the video data signal generating circuit 24. In the present embodiment, the scan circuit 23, the voltage supply circuit 22, the voltage setting circuits 9, the current measuring circuits 8, the video data signal generating circuit 24, and the controller 25 are provided separately from, but connected to, the board on which the pixels are fabricated. Alternatively, all or any of these components may be fabricated on the same board as the pixels using TFT technology.

Now, the structure of the pixel in the organic EL display will be explained.

Figure 8:
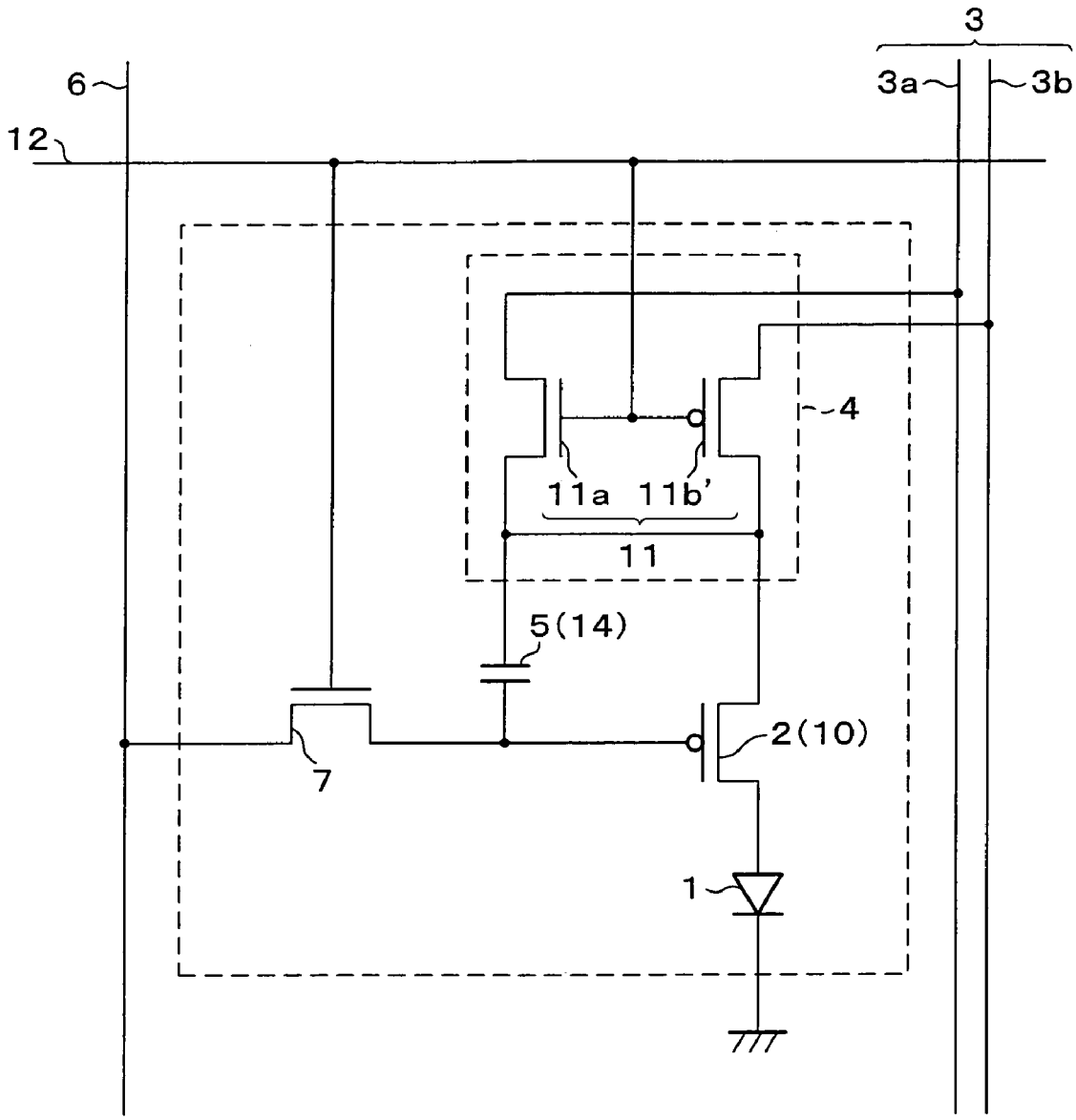
FIG. 8 is a schematic diagram of a pixel in the display depicted in FIG. 7.

As shown in FIG. 8, each pixel includes as a photoelectric element 1 an organic EL element which is connected in series to a drive-switching element 2 built around a p-type FET 10. Potential holding means 5 (holding capacitor 14) is connected to the drive-switching element 2. A scan switching element 7 for providing a video data signal from the video data signal line 6 to the potential holding means 5 in accordance with the scan action using the scan signal lines 12 is formed using an n-type FET and connected to the potential holding means 5 and the drive-switching element 2. The current injecting path 3 leading to the pixel can be switched by the path selector switching element 4 between the current injecting paths 3*a* and 3*b*.

Figure 17:
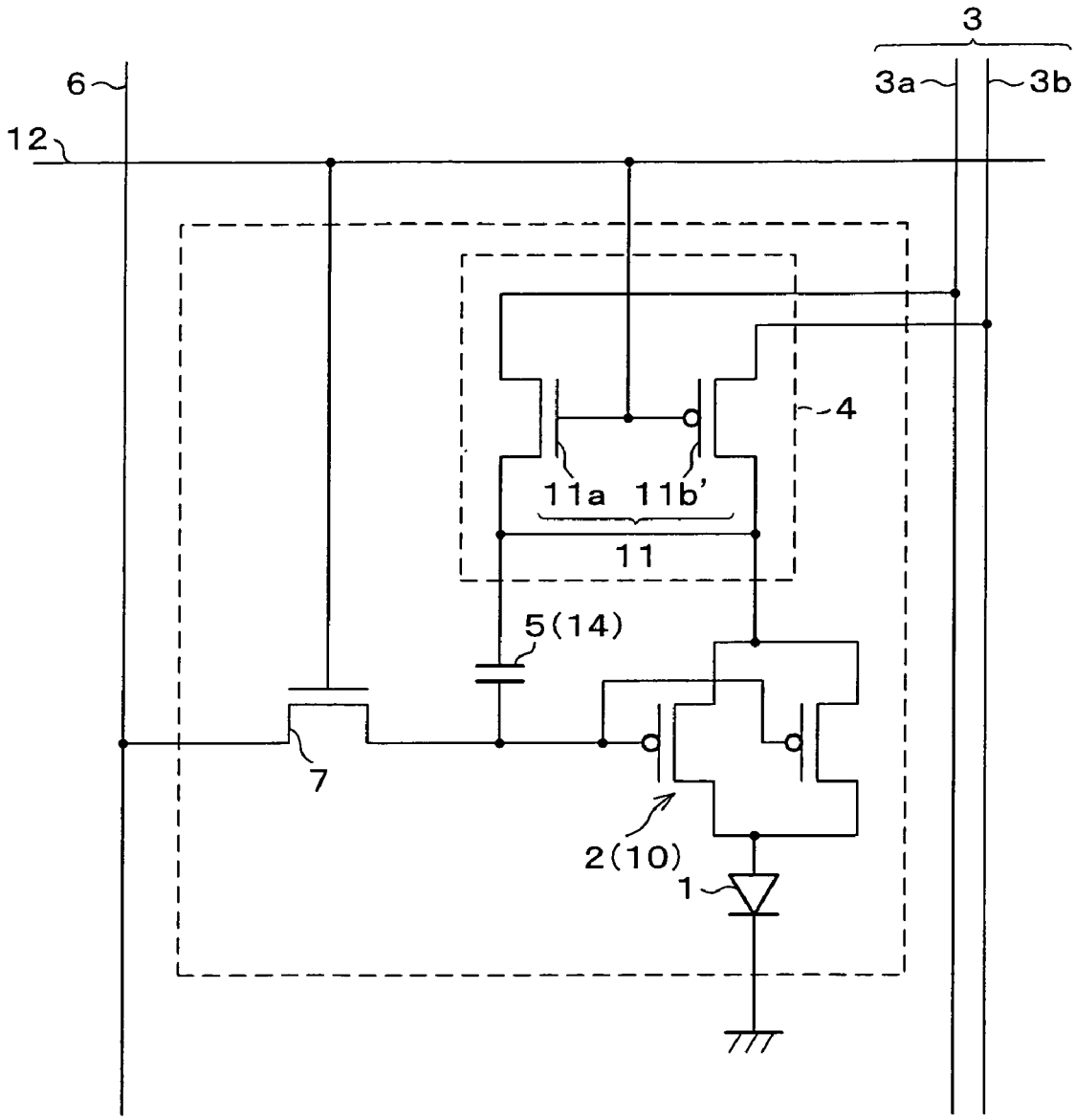
FIG. 17 is another schematic diagram of a pixel in the display in FIG. 7.

When the photoelectric element 1 requires such a great current that exceeds the supply capability of the drive-switching element 2 built around a single FET 10, the drive-switching element 2 could be built including two or more FETs 10 connected in parallel as in FIG. 17 showing such a pixel. In this example, the drive-switching element 2 includes two FETs 10 and is capable of supplying greater current to the photoelectric element 1 than in the case involving a single FET 10.

Referring to FIG. 7, the current injecting path 3*a* is connected to the current source Vdd and the current measuring circuits 8, and the current injecting path 3*b* is connected to the current source Vdd. Each video data signal line 6 is connected to a voltage setting circuit 9 which compares the measured value of the current from the current measuring circuit 8 with the video data signal voltage supplied for the associated pixel from the video data signal generating circuit 24 and specifies the voltage applied to the video data signal line 6.

In FIG. 8, the p-type FET 10, constituting the drive-switching element 2, is connected to the photoelectric element 1 at the drain terminal, the path selector switching element 4 at the source terminal, and the potential holding means 5 and the scan switching element 7 at the gate electrode.

The path selector switching element 4 includes multiple FETs 11. In the particular example shown in FIG. 8, the path selector switching element 4 includes an n-type FET 11*a* and a p-type FET 11*b*'. Each FET 11*a*, 11*b*' is connected to the drive-switching element 2 at the drain terminal, the associated one of the current injecting paths 3*a*, 3*b* at the source terminal, and the scan signal line 12 at the gate terminal.

An organic EL layer used as the photoelectric element 1, similarly to the one in embodiment 1, is made of, for example, a TFT-carrying glass board, transparent ITO anodes provided thereon, multiple organic layers provided thereon, and Al cathodes provided thereon. The organic layers are made up of a hole injection layer (or anode buffer layer) (CuPc), light-emitting layers (green, Alq; red, Alq doped with DCM; blue, Zn(oxz)2), a hole transport layer (TPD), and an electron transport layer (Alq), deposited in the order.

Here, transparent electrodes are provided on the side of the glass board so that light emission is observable on the glass board side. Alternatively, light emission may be observed on the opposite side of the board by forming an opaque electrode (metal electrode) on the TFT-carrying board, multiple organic layers thereon, and transparent electrodes further thereon.

Figure 9:
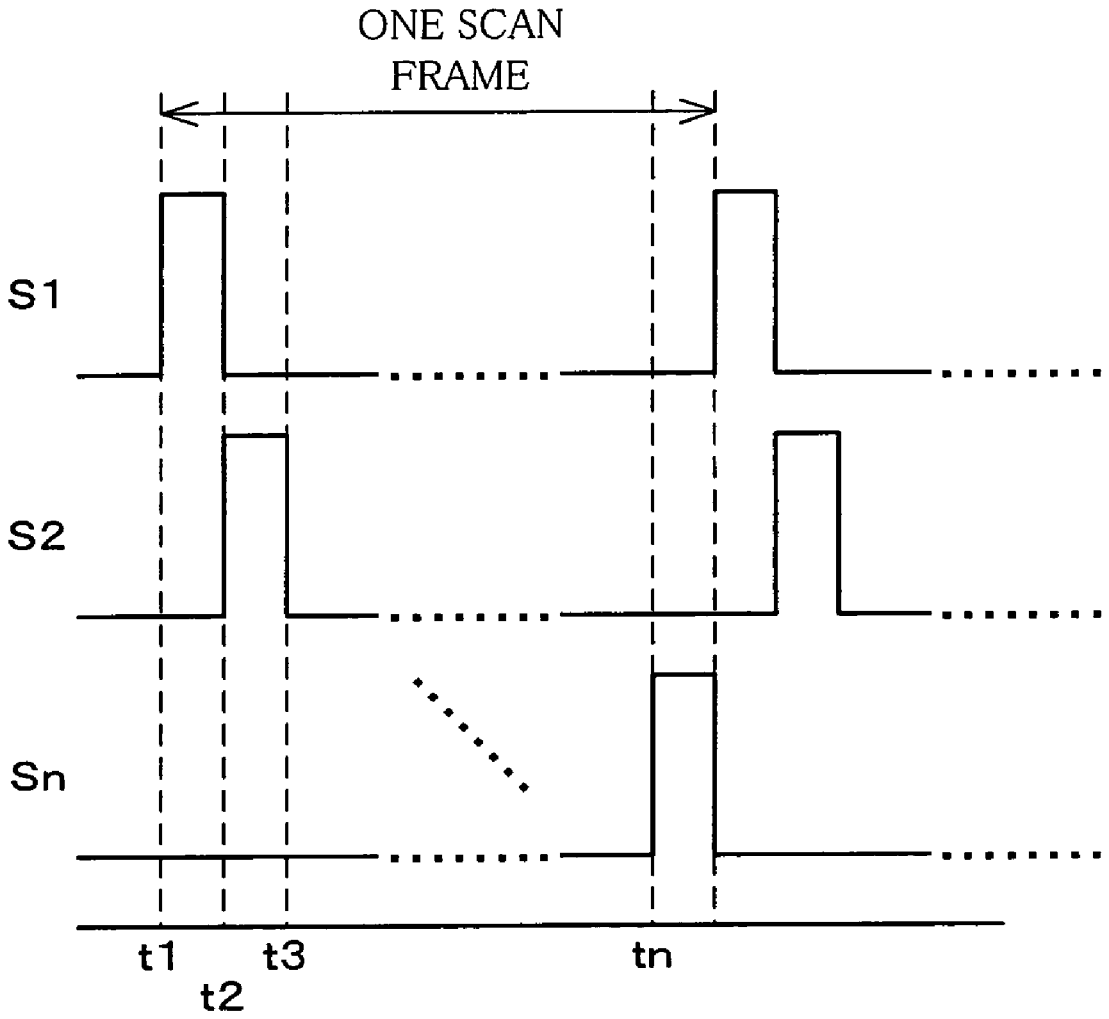
FIG. 9 is a waveform chart showing scan signals in the display depicted in FIG. 7.
Figure 10:
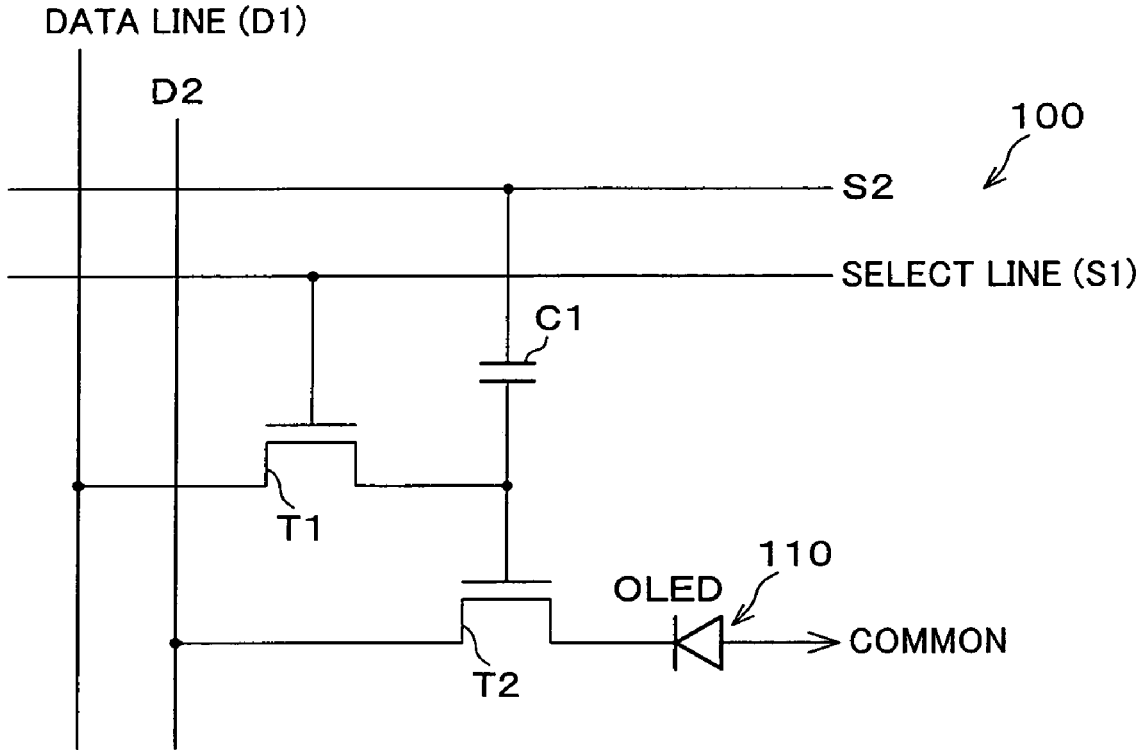
FIG. 10 PRIOR ART
FIG. 10 is a schematic diagram of a pixel in a conventional display.
Figure 11:
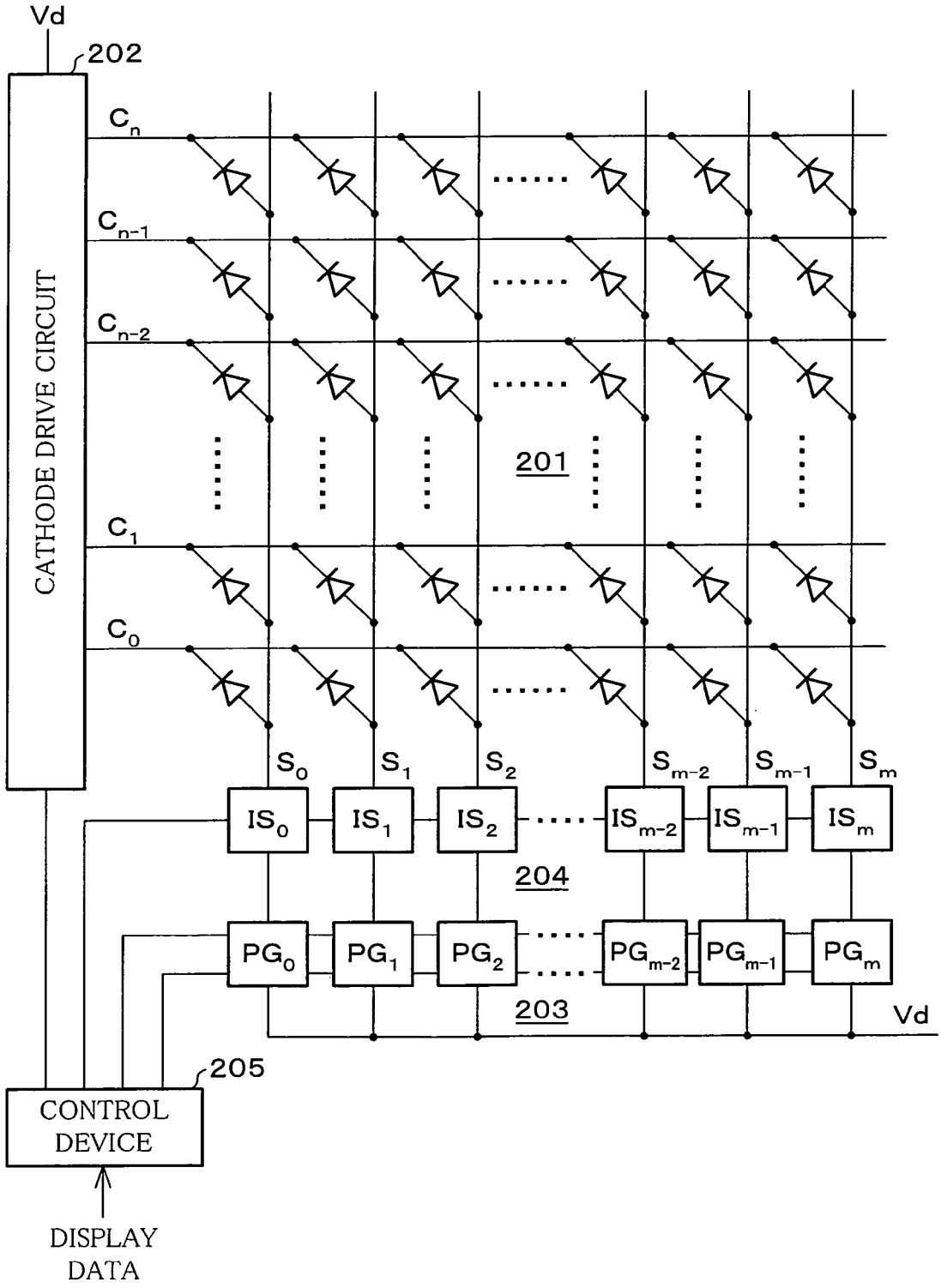
FIG. 11 PRIOR ART
FIG. 11 is a schematic block diagram of a conventional display.
Figure 12:
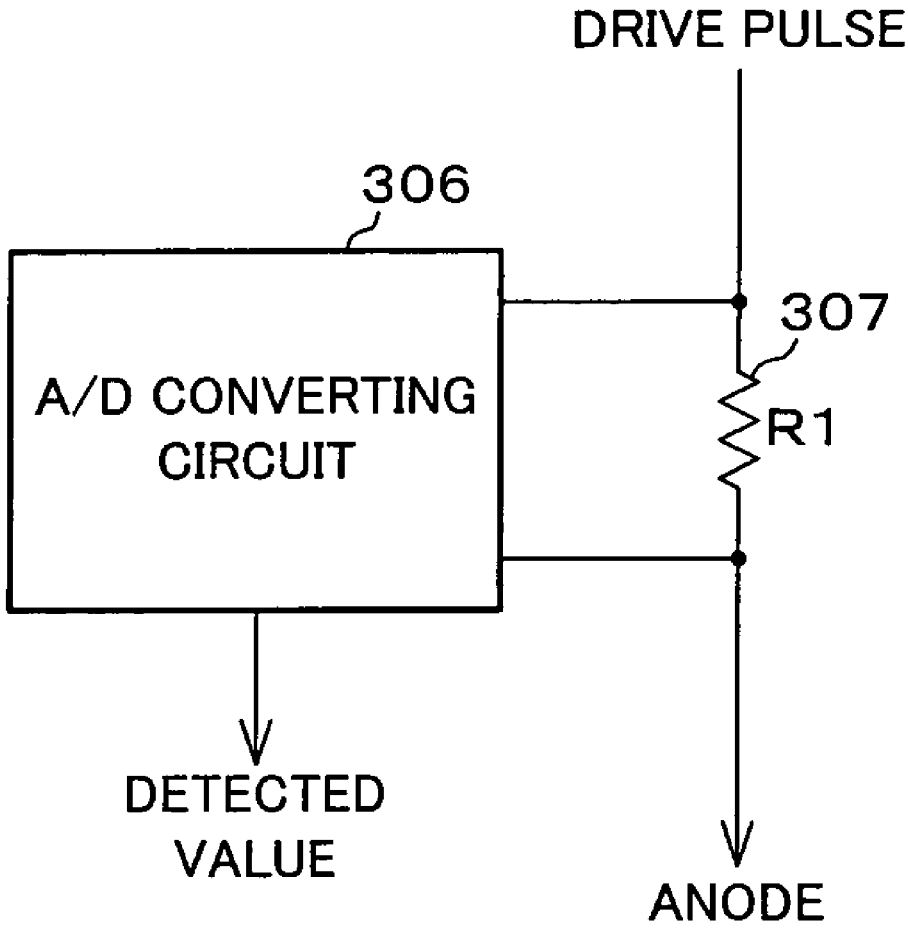
FIG. 12 PRIOR ART
FIG. 12 is a schematic block diagram of a current detecting circuit incorporated in the display in FIG. 11.
Figure 13:
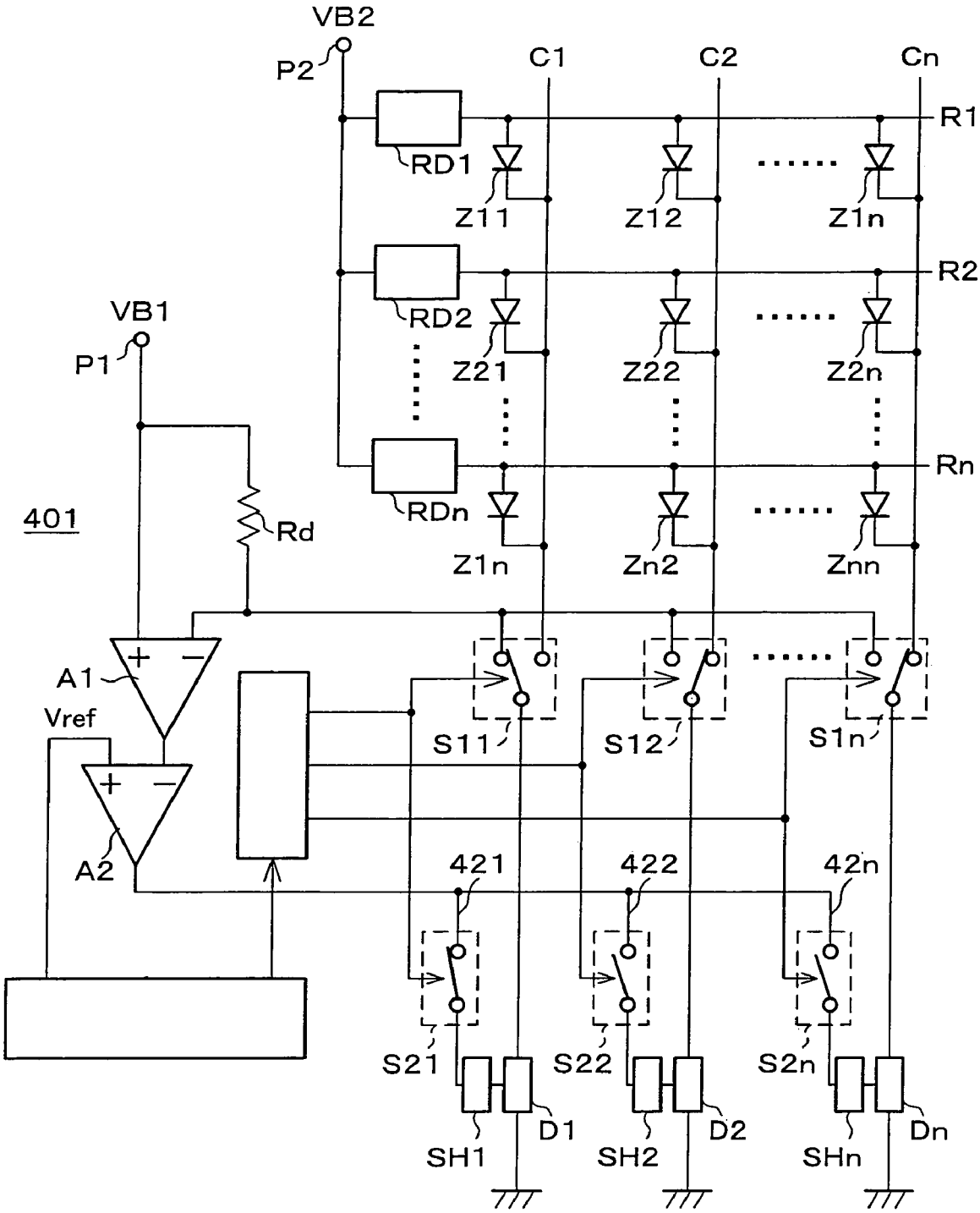
FIG. 13 PRIOR ART
FIG. 13 is a schematic block diagram of a conventional display.
Figure 14:
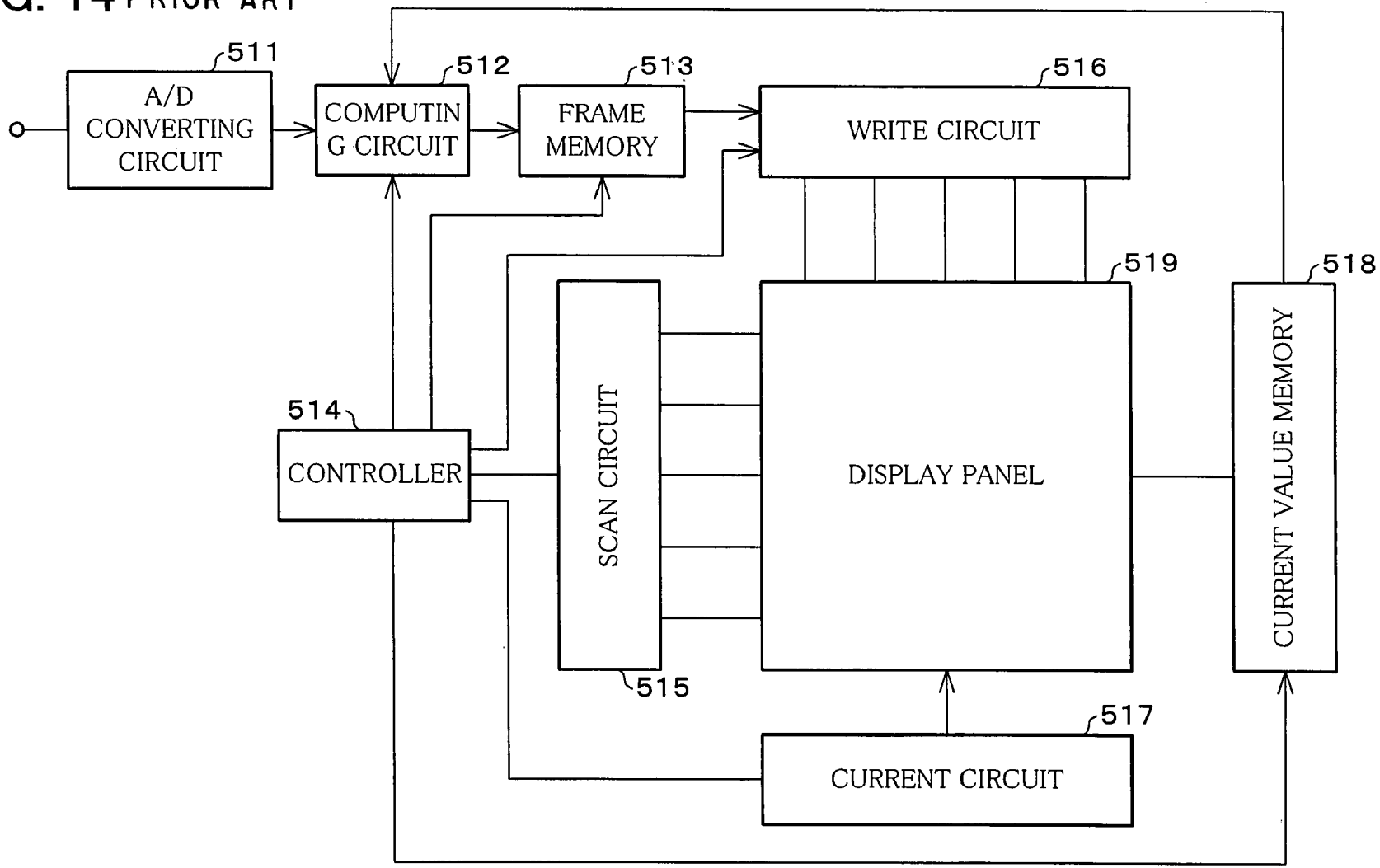
FIG. 14 PRIOR ART
FIG. 14 is a schematic block diagram of a conventional display.
Figure 15:
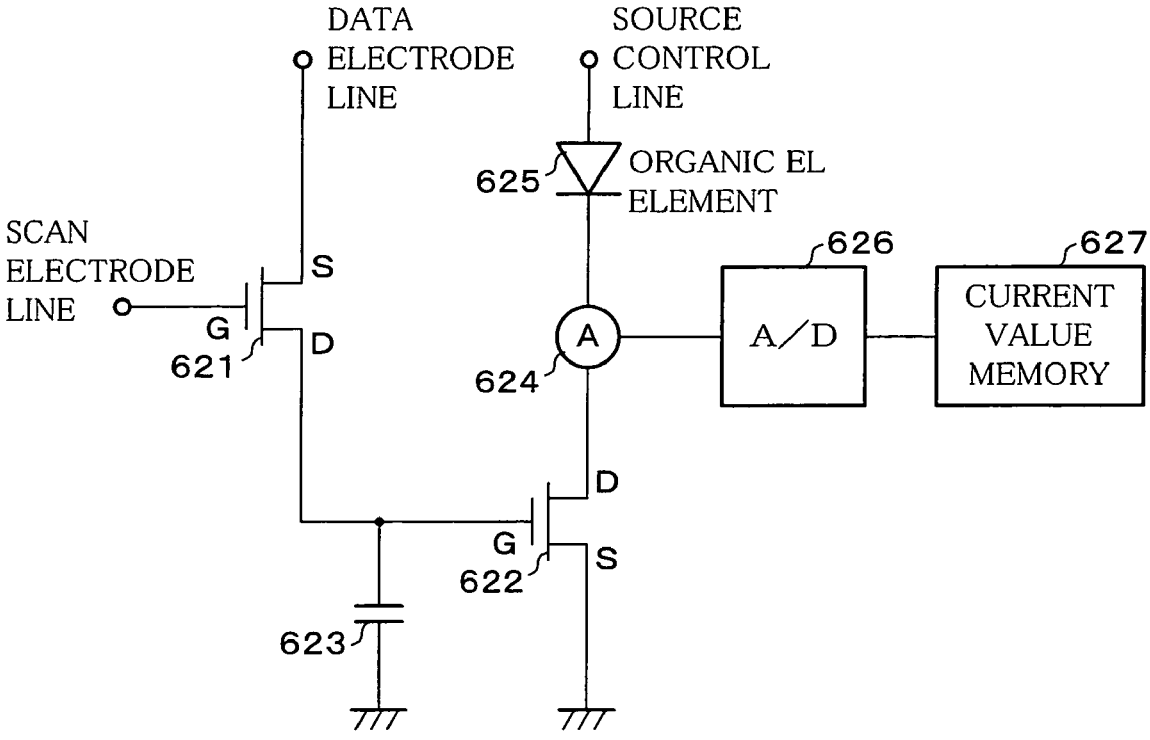
FIG. 15 PRIOR ART
FIG. 15 is a schematic diagram of a pixel in a conventional display.

The current measuring circuits 8 and the voltage setting circuits 9 are arranged identically to those detailed in embodiment 1. FIG. 9 shows as an example a drive waveform of the display illustrated in FIGS. 7, 8. In FIG. 9, S1, S2, and Sn represent the scan signal voltage applied to the scan signal lines 12∅S1, S2, and Sn in FIG. 6.

In one scan frame, the scan signal lines S1, S2, . . . , and Sn are selected (scanned) line by line. The scan signal lines S1, S2, . . . , and Sn are HIGH when selected and inverted, i.e., LOW, when not selected. At time t1, S1, and hence the pixels P11, P12, . . . , and P1*m*, is selected with the other scan signal lines not selected. This period is the scan period for the pixels P11, P12, . . . , and P1*m* in a frame.

Still referring to FIG. 9, during the period between times t1 and t2 (scan period for the pixels P11, P12, . . . , and P1*m*), S1 is HIGH. Thus, in each of the pixels P11, P12, . . . , and P1*m*, the FET 11*a* conducts and the FET 11*b*' does not conduct, electrically coupling the drive-switching element 2 and the photoelectric element 1 to the current source 13 via the current injecting path 3*a* (see FIG. 8). In the pixels other than P11, P12, . . . , and P1*m*, the FET 11*a* does not conduct and the FET 11*b*' conducts, electrically coupling the drive-switching element 2 and the photoelectric element 1 to the current source 13 via the current injecting path 3*b*.

The current injecting path 3*a* is coupled to the current measuring circuits 8 where the current values in the selected pixels can be measured sequentially. Because current is supplied to the non-select pixels via the other current injecting path 3*b*, the current values in the selected pixel can be measured sequentially without being adversely affected by the current flows through the non-select pixels.

Only in the pixels P11, P12, . . . , and P1*m*, does the scan switching element 7 conduct, allowing the voltage on the video data signal line 6 to be applied to the drive-switching element 2. In the other pixels, the scan switching element 7 does not conduct, electrically isolating the video data signal line 6 from the drive-switching element 2.

During the period between times t1 and t2, video data is written to, and held by, the selected pixels P11, P12, . . . , and P1*m*. The voltage supply circuit 22 supplies signal voltage which is applied to the video data signal lines 6 associated with the pixels via the respective voltage setting circuits 9. Under these circumstances, the current values from the current injecting path 3*a* through the pixels are sequentially measured by the current measuring circuits 8 where the current measurements are converted to voltage values before being transmitted to the voltage setting circuits 9.

Each voltage setting circuit 9 then compares the incoming value with the video data voltage received, as a video data signal, from the associated video data signal generating circuit 24 and specifies the applied voltage to the video data signal line 6 so that the current flow through the pixel has a value which corresponds to the video data signal. The voltage is applied to the gate terminal of the drive-switching element 2 via the conducting scan switching element 7, so as to control an injection current to the photoelectric element 1.

Specifying the applied voltage to the video data signal line 6 in reference to the current value through the pixel in this manner can achieve constant luminance corresponding to the video data signal regardless of potential aging and irregularity in characteristics among the switching elements and the photoelectric elements 1 constituting the pixels. Under these circumstances, the applied voltage to the video data signal line 6 is not only applied to the drive-switching element 2 via the scan switching element 7, but also stored by the potential holding means 5.

The subsequent period between t2 and t3 in FIG. 9 is allocated for the scanning of the pixels P21, P22, . . . , and P2*m*. During the period, the scan signal line S2 corresponding to the pixels P21, P22, . . . , and P2*m* is selected, and the other scan signal lines are not selected. That is, S2 is HIGH, and Sx is LOW (x=1 to n except for 2).

In the previously selected pixels P11, P12, . . . , and P1*m*, the scan switching element 7 now no longer conducts, cutting off the voltage application from the video data signal line 6 to the pixel. Nevertheless, the drive-switching element 2 remains conducting due to the charge buildup in the potential holding means 5 during the period between times t1 and t2. Therefore, in the pixels P11, P12, . . . , and P1*m*, the FET 11*a* remains not conducting, and the FET 11*b*' remains conducting, allowing current to flow from the current injecting path 3*b* to the photoelectric element 1 in accordance with the conducting state of the drive-switching element 2.

In this manner, in P11, P12, . . . , and P1*m*, the pixel current specified during the select period continues to flow even in the non-select period. The pixel current, and hence luminance, can be maintained at a substantially constant value until the pixel is selected next time in the subsequent frame.

During this period starting at t2 and ending at t3, in the pixels P21, P22, . . . , and P2*m*, the FET 11*a* conducts and the FET 11*b*' does not conduct; in the other pixels, the FET 11*a* does not conduct and the FET 11*b*' conducts. That is, in the pixels P21, P22, . . . , and P2*m*, the drive-switching element 2 and the photoelectric element 1 are coupled to the current source 13 via the current injecting path 3*a*; in the other pixels, the elements 1, 2 are coupled to the current source 13 via the current injecting path 3*b*.

Consequently, as to the currently selected (scanned) pixels P21, P22, . . . , and P2*m*, the current measuring circuit 8 can measure the pixel current value through the current injecting path 3*a*, independently from the non-select pixels. Under these circumstances, similarly to the period between t1 and t2, the voltage supply circuit 22 applies a signal voltage to the currently selected pixels P21, P22, . . . , and P2*m* via the respective voltage setting circuits 9 and video data signal lines 6. Under these circumstances, the current values from the current injecting path 3*a* through the pixels are sequentially measured by the current measuring circuits 8 where the current measurements are converted to voltage values before being transmitted to the voltage setting circuits 9.

Each voltage setting circuit 9 then compares the incoming value with the video data signal voltage across the pixel received from the associated video data signal generating circuit 24 and specifies the applied voltage to the video data signal line 6 so that the current flow through the pixel has a value which corresponds to the video data signal. The applied voltage to the video data signal line 6 is applied to the drive-switching element 2 via the scan switching element 7, so as to control the current through the photoelectric element 1. Concurrently, the applied voltage to the video data signal line 6 is stored by the potential holding means 5.

During the period t3, the scan signal lines S2 corresponding to the pixels P21, P22, . . . , and P2*m* are not selected, isolating the pixels from the video data signal lines 6. However, similarly to the pixels P11, P12, . . . , and P1*m*, the charge buildup in the potential holding means 5 continues to control the drive-switching element 2, keeping the luminance of the photoelectric element 1 at a predetermined value.

Similarly, P31, P32, . . . , and P3*m* are selected during the period starting at t3, and then P41, P42, . . . , and P4*m* are selected during the period starting at t4. The process is repeated line by line until the Pn1, Pn2, . . . , and Pnm are selected during the period starting at tn, which completes the writing of video data to all the pixels, ending one scan frame. Repeating that scan frame enables an image to be continuously produced.

The use of the display and its driving method successfully produces bright images with no display irregularity.

The embodiment above involved one FET on each current injecting path; as a whole, the number of FETs is equal to the number of current injecting paths. The configuration may vary.

For example, multiple FET may be provided in series on each current injecting path if a single FET gives a poor OFF resistance, and in parallel on each path if a single FET gives a poor ON resistance.

Accordingly, the number of FETs can be equal to the number of current injecting paths when a single FET offers good ON and OFF resistance characteristics.

A display in accordance with the present invention may include: multiple photoelectric elements 1 as pixels; scan signal lines 12 for sequentially scanning the photoelectric elements 1; and video data signal lines 6 for supplying video data signals, wherein: a drive-switching element 2 is connected in series with each photoelectric element 1; potential holding means 5 for maintaining the potential matching with a video data signal is connected to each drive-switching elements 2; a scan switching element 7 for the video data signal from the video data signal lines 6 to the potential holding means 5 according to the scanning action through the scan signal lines 12 is connected to each potential holding means 5; multiple current paths 3 for current through the photoelectric elements 1 and drive-switching elements 2 exist; and the current injecting paths 3 are selectable through the path selector switching elements 4 each provided for a different photoelectric element 1.

At least one of the current injecting paths 3 may be arranged to be connected to a current measuring circuit 8.

A voltage setting circuit 9 may be connected to each the video data signal line 6, so as to set the applied voltage to the video data signal line 6 according to the measured current value from the current measuring circuit 8.

The drive-switching element 2 may be arranged from at least one FET 10, with either its source or drain terminal being connected to the photoelectric element 1 and the other of the source and drain terminals being connected to the path selector switching element 4.

Each path selector switching element 4 may be arranged from multiple FETs 11.

Each FET 11 may be arranged to include at least one n-type FET and at least one p-type FET.

Each FET 11 constituting the path selector switching element 4 may be arranged to be connected at its source or drain terminal to the drive-switching element 2 and at the other of the source and drain terminals to the current injecting path 3.

Each FET 11 constituting the path selector switching element 4 may be arranged to be connected at its gate terminal to the scan signal line 12.

The potential holding means 5 may be arranged from a holding capacitor 14.

The holding capacitor 14 may be arranged to be connected to the gate terminal the FET 10 constituting the drive-switching element 2.

The photoelectric element 1 may be arranged from an organic electroluminescence element.

The method of the invention may be a method of driving a display arranged in the foregoing, wherein a different multiple current path 3 is used during a scan period during which a potential matching with the video data signal is written to the potential holding means 5 and during the time period other than that period.

The method may be arranged so that current flows to the photoelectric element 1 and the drive-switching element 2 through the current path 3 to which the current measuring circuit 8 is connected during the scan period, and current flows to the photoelectric element 1 and the drive-switching element 2 through the current path 3 to which the current measuring circuit 8 is not connected during the period other than the scan period.

The method may be arranged so that the current value to the photoelectric element 1 and drive-switching element 2 is monitored as a voltage value using the current measuring circuit 8 during the scan period, and the voltage setting circuits 9 sets the applied voltage to the video data signal lines 6 to make the current value equal to a predetermined current value matching with the video data signal.

Generally, in an active matrix display, as in an active matrix display arranged as disclosed in Tokukaihei 10-254410 as an example, current flows to the organic EL element in the pixel even if the scan electrode line is not being selected and not scanned. Therefore, a current flow through each organic EL element cannot be measured by the technique whereby current is measured for each signal line side as in the disclosure of Tokukai 2000-187467. For the same reasons, current flow through each organic EL element cannot be measured by the technique disclosed in Tokukaihei 11-338561 whereby a selector switch is provided for each column electrode to enable selection between the current path when current is being measured and the current path when light is being emitted.

Therefore, in the active matrix display, current measuring means needs to be provided for each pixel as in the disclosure of Tokukaihei 10-254410 or a write select mode and a write non-select mode need to be implemented before entering a light-emitting mode as in the disclosure of Tokukaihei 10-319908. In the former, current measuring means is provided for each pixel, which will likely lower the TFT integration in each pixel and the panel's aperture ratio. In the latter, a no-light-emitting period occurs in one scan frame period, which will lead to reduced luminance.

In the present invention, in the active matrix display, multiple current injecting paths to the optical element in each pixel are provided, and a path selector switching thereof is provided for each pixel. This enables the control of (switching between) the current injecting paths for each pixel. That is, measurement and correction of the injection current to the pixel when it is being selected are enabled regardless of the light emission state of the pixel during a non-select period, by using a different current injecting path which injects current to the pixel during a scan select period and during a non-select period, and for example, providing a current measuring and correcting circuit only to the current injecting path which injects current to the pixel during a scan select period. In this case, a current measuring and correcting circuit needs to be provided for each column electrode, not for each pixel like current measuring means of Tokukaihei 10-254410. Unlike the technology disclosed in Tokukaihei 10-319908, almost no no-light-emitting period occurs in one scan frame.

In other words, the present invention enables the provision of current measuring means without reducing aperture ratio and the offering of displays that produce no irregularities, no reduction in aperture ratio, and almost no no-light-emitting period.

In the display arranged as in the forgoing, a current measuring circuit which measures current may be connected to at least one of the current supply paths, and a voltage setting circuit for setting the applied voltage to the video data signal line according to the measured current value measured by the current measuring circuit may be connected to the video data signal line.

Each drive-switching element may be arranged from at least one field effect transistor, with either one of the source and drain terminals of the field effect transistor being connected to the light-emitting element, and the other one of the source and drain terminals being connected to the path selector switching element.

Further, the path selector switching element may be arranged from multiple field effect transistors.

Each field effect transistor preferably includes at least one n-type field effect transistor and at least one p-type field effect transistor.

Either one of the source and drain terminals of each field effect transistor constituting the path selector switching element may be connected to the drive-switching element, and the other one of the source and drain terminals may be connected to the current supply path.

Further, the gate terminal of each field effect transistor constituting the path selector switching element may be connected to the scan signal line.

Signal holding means for maintaining a video data signal may be connected to the drive-switching element, and the signal holding means may be arranged from a holding capacitor. The holding capacitor is preferably connected to the gate terminal of the field effect transistor constituting the drive-switching element.

The light-emitting element used in the present invention may be an organic electroluminescence element, FED (field emission device), or another device that emits light on current supply.

Current may be supplied to the light-emitting element through a current supply path for current measurement during a scan period and through a current supply path other than the current supply path used for current measurement during a period other than the scan period.

Applied voltage to the video data signal line may be adjusted during the scan period so that the measured value of the current matches with the value of the video data signal according to the measured value of the current supplied to the light-emitting element through the current supply path used for current measurement.

Generally, in an active matrix display, current flows to the light-emitting element in the pixel even if the scan electrode line is not being selected and not scanned. Therefore, a current flow through each light-emitting element cannot be measured by the technique whereby current is measured for each signal line. For the same reasons, current flow through each light-emitting element cannot be measured by the switching technique whereby a selector switch is provided for each column electrode to switch the current path for current measurement and light emission.

Therefore, in the active matrix display, current measuring means needs to be provided for each pixel or a write select mode and a write non-select mode need to be implemented before entering a light-emitting mode. In the former, current measuring means is provided for each pixel, which will likely lower the TFT integration in each pixel and the panel's aperture ratio. In the latter, a no-light-emitting period occurs in one scan frame period, which will lead to reduced luminance.

In the present invention, in the active matrix display, multiple current supply paths (current injecting paths) to the optical element in each pixel are provided, and a path selector switching thereof is provided for each pixel. This enables the control of (switching between) the current injecting paths for each pixel. That is, measurement and correction of the injection current to the pixel when it is being selected are enabled regardless of the light emission state of the pixel during a non-select period, by using a different current injecting path which injects current to the pixel during a scan select period and during a non-select period, and for example, providing a current measuring and correcting circuit only to the current injecting path which injects current to the pixel during a scan select period.

In this case, a current measuring and correcting circuit needs to be provided for each column electrode, not for each pixel like current measuring means of a conventional active matrix display. Unlike in passive matrix displays, almost no no-light-emitting period occurs in one scan frame.

From the foregoing, the present invention enables the provision of current measuring means without reducing aperture ratio and the offering of displays that produce no irregularities, no reduction in aperture ratio, and almost no no-light-emitting period.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display including:

scan signal lines and video data signal lines arranged to form a matrix;

pixels each connected to one or two of the scan signal lines and one of the video data signal lines; and current supply paths, each of said pixels comprising:

a light-emitting element for emitting light on receipt of a current supply;

a path selector switching element whose source and drain electrodes are disposed between the light-emitting element and the current supply paths for supplying said light-emitting element with said current supply from either of the current supply paths and whose gate electrodes are in connection with the one or two scan signal lines for selecting which current supply path provides said light-emitting element with said current supply; and a drive-switching element that connects the light-emitting element to the path selector switching element.

2. A display including:

pixels arranged in rows and columns to form a matrix;

scan signal lines for driving the pixels row by row;

video data signal lines for supplying a video data signal to the pixels; and current supply paths for supplying a current to the pixels, each of said pixels comprising:

a light-emitting element for emitting light on receipt of a current supply;

a path selector switching element whose source and drain electrodes are disposed between the light-emitting element and the current supply paths for supplying said light-emitting element with said current supply from either of the current supply paths and whose gate electrodes are in connection with the one or two scan signal lines to select which current supply path provides said light-emitting element with said current supply; and a drive-switching element for supplying to the light-emitting element a current supply which matches the video data signal supplied through one of the video data signal lines.

3. The display as defined in claim 2, further including current measuring circuits, each connected to at least one of the current supply paths, for measuring current flows.

4. The display as defined in claim 3, further including voltage setting circuits, each connected to a different one of the video data signal lines, for setting applied voltages to the video data signal lines according to current values measured by the current measuring circuits.

5. The display as defined in claim 2, wherein:

the drive-switching element is made of at least one field effect transistor; and the field effect transistor is connected at either one of a source terminal and a drain terminal thereof to the light-emitting element and at the remaining one of the source terminal and the drain terminal to the path selector switching element.

6. The display as defined in claim 2, wherein the path selector switching element is made of field effect transistors.

7. The display as defined in claim 6, wherein at least one of the field effect transistors is of an n type, and at least another one is of a p type.

8. The display as defined in claim 6, wherein each of the field effect transistors is connected at either one of a source terminal and a drain terminal thereof to the drive-switching element and at the other of the source terminal and the drain terminal to the current supply paths.

9. The display as defined in claim 6, wherein each of the field effect transistors is connected at a gate terminal thereof to one of the scan signal lines.

10. The display as defined in claim 2, wherein:

signal holding means for holding the video data signal is connected to the drive-switching element; and the signal holding means is constituted by a holding capacitor.

11. The display as defined in claim 10, wherein:

the holding capacitor is connected to a gate terminal of a field effect transistor constituting the drive-switching element.

12. The display as defined in claim 2, wherein:

the light-emitting element is an organic electroluminescence element.

13. A method of driving a display including:

pixels arranged in rows and columns to form a matrix;

scan signal lines for driving the pixels row by row;

video data signal lines for supplying a video data signal to the pixels; and current supply paths for supplying a current to the pixels, each of said pixels including:

a light-emitting element for emitting light on receipt of a current supply;

a path selector switching element whose source and drain electrodes are disposed between the light-emitting element and the current supply paths for supplying said light-emitting element with the current supply from one of the current supply paths and whose gate electrodes are in connection with the scan signal lines for switching between the current supply paths according to a scan signal supplied by one of the scan signal lines; and a drive-switching element for supplying to the light-emitting element said current supply which matches with the video data signal supplied through one of the video data signal lines;

said method comprising the step of using the first current supply path, through which a current is supplied to the light-emitting element, during a scan period during which the light-emitting element is being driven, and the second current supply path during a time period other than the scan period.

14. The method as defined in claim 13, wherein during the scan period, a current is supplied to the light-emitting element through the first current supply path being used for current measurement; and during the time period other than the scan period, a current is supplied to the light-emitting element through the second current supply paths.

15. The method as defined in claim 13, wherein during the scan period, a voltage applied to one of the video data signal lines is adjusted, according to a measured value of the current supplied to the associated light-emitting element through the current supply path used for current measurement, so that a measured value of the current equals a value matching with the video data signal.

16. A method of driving a display including as pixels light-emitting elements for emitting light on a current supply, said method comprising the steps of:

(a) sequentially driving the light-emitting elements;

(b) supplying a video data signal to the light-emitting elements; and (c) supplying a current which matches with the video data signal to the light-emitting elements through one of current supply paths, wherein in step (c), one of the current supply paths is selected for use during a scan period during which the light-emitting element is being driven, and a different one of the current supply paths is selected for use during a time period other than the scan period.

17. A display including:

scan signal lines and video data signal lines arranged to form a matrix;

pixels each connected to one or two of the scan signal lines and one of the video data signal lines; and current supply paths, each of said pixels comprising:

a light-emitting element for emitting light on receipt of a current supply;

a path selector switching element whose source and drain electrodes are disposed between the light-emitting element and the current supply paths for supplying said light-emitting element with the current supply from one of the current supply paths; and a drive-switching element that connects the light-emitting element to the path selector switching element; and wherein the path selector switching element switches between a first current supply path for selected pixels and a second current supply path for non-selected pixels.

18. A display including:

pixels arranged in rows and columns to form a matrix;

scan signal lines for driving the pixels row by row;

video data signal lines for supplying a video data signal to the pixels; and current supply paths for supplying a current to the pixels, each of said pixels comprising:

a light-emitting element for emitting light on receipt of a current supply;

a path selector switching element whose source and drain electrodes are disposed between the light-emitting element and the current supply paths for supplying said light-emitting element with the current supply from either of the current supply paths and whose gate electrodes are in connection with the scan signal lines, for switching between the current supply paths according to a scan signal supplied through one of the scan signal lines; and a drive-switching element for supplying to the light-emitting element a current which matches with the video data signal supplied through one of the video data signal lines; and wherein the path selector switching element switches between a first current supply path for selected pixels and a second current supply path for non-selected pixels.

* * * * *